US010938109B2

(12) United States Patent
Georgakopoulos et al.

(10) Patent No.: US 10,938,109 B2
(45) Date of Patent: Mar. 2, 2021

(54) FOLDABLE AND RECONFIGURABLE ANTENNAS, ARRAYS AND FREQUENCY SELECTIVE SURFACES WITH RIGID PANELS

(71) Applicants: Stavros Georgakopoulos, Miami, FL (US); Shun Yao, Miami, FL (US)

(72) Inventors: Stavros Georgakopoulos, Miami, FL (US); Shun Yao, Miami, FL (US)

(73) Assignee: The Florida International University Board of Trustees, Miami, FL (US)

( * ) Notice: Subject to any disclaimer, the term of this patent is extended or adjusted under 35 U.S.C. 154(b) by 0 days.

(21) Appl. No.: 16/504,634

(22) Filed: Jul. 8, 2019

(65) Prior Publication Data

US 2021/0013614 A1 Jan. 14, 2021

(51) Int. Cl.

| | |
|---|---|
| ***H01Q 1/08*** | (2006.01) |
| ***H01Q 11/04*** | (2006.01) |
| ***H01Q 13/16*** | (2006.01) |

(52) U.S. Cl.
CPC ..... *H01Q 11/04* (2013.01); *H01Q 13/16* (2013.01)

(58) Field of Classification Search
CPC ..... H01Q 1/38; H01Q 1/1264; H01Q 11/04
See application file for complete search history.

(56) References Cited

U.S. PATENT DOCUMENTS

| | | | | |
|---|---|---|---|---|
| 2015/0041540 | A1* | 2/2015 | Qu | G06K 7/10316 235/439 |
| 2015/0171506 | A1* | 6/2015 | Murakami | H01Q 21/30 343/702 |
| 2017/0025748 | A1* | 1/2017 | Georgakopoulos | H01Q 1/08 |
| 2018/0151948 | A1* | 5/2018 | Thompson | H01P 1/047 |
| 2019/0221944 | A1* | 7/2019 | Harless | H01Q 1/1235 |

OTHER PUBLICATIONS

Shun Yao, Origami Reconfigurable Electromagnetic Systems, 2017, FIU Electronic Theses and Dissertations, pp. 1-120.*

Shun Yao et al., Morphing Origami Conical Spiral Antenna Based on the Nojima Wrap, IEEE Transactions on Antennas and Propagation, vol. 65, No. 5, May 2027. pp. 2222-2232.

Syed Imran Hussain Shah et al., Low-Cost Circularly Polarized Origami Antenna, IEEE Antennas and Wireless Propagation Letters, vol. 16, 2017, pp. 2026-2029.

Xueli Liu et al., An Origami Reconfigurable Axial-Mode Bifilar Helical Antenna, IEEE Transactions on Antennas and Propagation, vol. 63, No. 12, Dec. 2015, pp. 5897-5903.

Wenjing Su et al., Novel 3D printed Liquid-metal-alloy microfluidics-based Zigzag and Helical Antennas for Origami Reconfigurable Antenna "Trees", IEEE Internat. Microw, Symp., Honololu, HI, Jun. 4-9, 2017, pp. 1579-1582.

(Continued)

*Primary Examiner* — Dieu Hien T Duong
(74) *Attorney, Agent, or Firm* — Saliwanchik, Lloyd & Eisenschenk

(57) ABSTRACT

Foldable antenna devices formed on rigid substrates are provided. The substrate can be planar in an unfolded state, and a metal layer can be formed on the rigid substrate to act as an antenna element. The rigid substrate(s) can include mountain folds and valley folds, or hinges, such that the antenna device is foldable from an unfolded state to a fully folded state.

15 Claims, 30 Drawing Sheets

(56) References Cited

OTHER PUBLICATIONS

Shun Yao et al., Tunable UHF Origami Spring Antenna with Actuation System, IEEE Antennas Propagat. Soc. Internat. Symp., San Diego, CA, Jul. 9-14, 2017, pp. 325-326.
Zachary Abel et al., Rigid Origami Vertices: Conditions and Forcing Sets, J. of Computational Geomerty, vol. 7, No. 1, 2016, pp. 171-184.
Cheng LV, Theoretical and Finite Element Analysis of Origami and Kirigami Based Structures, Dissertation for the Doctor of Philosophy Degree, Arizona State University, Aug. 2016.
Nicholas Turner et al., A review of origami applications in mechanical engineering, Journal of Mechanical Eng. Sci., vol. 230, No. 14, 2016, pp. 2345-2362.
Shanon A. Zirbel et al., Accommodating Thickness in Origami-Based Deployable Arrays, Journal of Mechanical Design, vol. 135, No. 111005, Nov. 2013, pp. 1-11.
Xianming Qing et al., Segmented Spiral Antenna for UHF near-field RFID, IEEE Antennas Propagat. Soc. Internat. Symp., Spokane, WA., Jul. 3-8, 2011, pp. 996-999.
Qi Luo et al., A broadband printed monofilar square spiral antenna: A circularly polarized low-profile antenna, IEEE Antennas Propagat. Mag., vol. 59, No. 2, Apr. 2017, pp. 79-87.
Shun Yao et al., Origami Segmented Helical Antenna with Switchable Sense of Polarization, IEEE Access, vol. 6, 2018, pp. 4528-4536.
Thorsten W. Hertel et al., The Conical Spiral Antenna Over the Ground, IEEE Transactions on Antennas and Propagation, vol. 50, No. 12, Dec. 2002, pp. 1668-1675.
Dean A. Hofer et al., A Low-Profile, Broadband Balun Feed, IEEE Antennas Propagat. Society Internat. Symp., Jun. 28-Jul. 2, 1993, pp. 458-461.
Yu Shuan Yeh et al., Theory of Conical Equiangular-Sprial Antennas Part II—Current Distributions and Input Impedances, IEEE Trans. Antennas Propagat., vol. 16, No. 1, Jan. 1968, pp. 14-21.
Shannon A. Zirbel et al., Deployment Methods for an Origami-Inspired Rigid-Foldable Array, Energy Production and Conversion: Mech. Eng., May 1, 2014, pp. 189-194.

* cited by examiner

FOLDABLE AND RECONFIGURABLE ANTENNAS, ARRAYS AND FREQUENCY SELECTIVE SURFACES WITH RIGID PANELS

GOVERNMENT SUPPORT

This invention was made with government support under Grant Number 1332348 awarded by National Science Foundation (NSF). The government has certain rights in the invention.

BACKGROUND

Deployable antennas, which can be compressed and expanded, can be useful for many applications, such as satellite communications. In such applications, it is important for the antenna to be able to fit into a small space and to be able to expand to an operational size once orbit is reached. While the sensors and operating electronics of satellites can be scaled to small volumes, the wavelengths of the signals used by miniaturized satellites to communicate do not scale accordingly. Given that the wavelength of a signal determines the size of an antenna needed to communicate that signal, antennas for miniaturized satellites still must have dimensions similar to those for larger satellites. Because of these size limitations for deployable antennas, some of the advantages of satellite miniaturization remain unrealized.

BRIEF SUMMARY

Embodiments of the subject invention provide novel and advantageous foldable antenna devices formed on a rigid substrate. The substrate can be planar in an unfolded state. A metal layer (e.g., a copper layer) can be formed on the rigid substrate, which is foldable, and the metal layer can act as the antenna element. The rigid substrate can include mountain folds and valley folds such that it is foldable from its unfolded state to a fully folded state. Alternatively, multiple rigid substrates can be connected to each other by hinges such that the antenna device is foldable from an unfolded state to a fully folded state.

In an embodiment, a foldable antenna device can comprise a rigid substrate configured to be folded and an antenna element disposed on the rigid substrate. The rigid substrate can be configured to be folded by having predefined folding lines, hinges, or both, for folding into a predetermined configuration, such that the foldable antenna device has an unfolded state and a fully folded state. The antenna element can comprise a metal layer, which can be symmetrically disposed about a central hub of the rigid substrate. The foldable antenna device can be configured to operate as a linearly polarized dipole antenna in the unfolded state and a circularly polarized broadband antenna in the fully folded state. The foldable antenna can be a segmented conical spiral antenna (CSA) in the fully folded state.

In another embodiment, a method of fabricating a foldable antenna device can comprise: providing a rigid substrate configured to be folded; folding the rigid substrate to create folding lines such that the rigid substrate is configured to be folded into a predetermined configuration, such that the foldable antenna device has an unfolded state and a fully folded state; and forming an antenna element on the rigid substrate. The antenna element can be formed on the rigid substrate before or after folding the rigid substrate.

In another embodiment, a method of fabricating a foldable antenna device can comprise: providing a plurality of rigid substrates; connecting the rigid substrates to each other using at least one hinge such that the plurality of rigid substrates is configured to be folded into a predetermined configuration, such that the foldable antenna device has an unfolded state and a fully folded state; and forming an antenna element on the plurality of rigid substrates. The antenna element can be formed on the plurality of rigid substrates before or after connecting the rigid substrates to each other with hinges.

DETAILED DESCRIPTION

Embodiments of the subject invention provide novel and advantageous foldable antenna devices formed on a rigid substrate. The substrate can be planar in an unfolded state. A metal layer (e.g., a copper layer) can be formed on the rigid substrate, which is foldable, and the metal layer can act as the antenna element. The rigid substrate can include mountain folds and valley folds such that it is foldable from its unfolded state to a fully folded state, as well as to intermediate folded states as well (if desired). Alternatively, multiple rigid substrates can be connected to each other by hinges such that the antenna device is foldable from an unfolded state to a fully folded state, as well as to intermediate folded states as well (if desired).

In some embodiments, the antenna can be a conical spiral antenna (CSA) (e.g., a segmented CSA) in its folded state, and the rigid substrate can include mountain folds and valley folds such that when it is folded, it is a CSA. The rigid substrate can have folds (e.g., mountain folds and valley folds) such that it is an origami flasher model (see, e.g., FIGS. 1A, 5A, 17, 18A, 19A, and 19D), though embodiments are not limited thereto. An origami flasher model can be folded to result in a segmented CSA (see, e.g., FIGS. 1B, 3A, 6, 18A, 18B, 19B, 19C, 19E, and 19F).

In some embodiments, a balun (e.g., a microstrip balun) can be attached to the rigid substrate, electrically connected to the metal layer, such that the balun is part of the antenna in the folded state as well (e.g., the balun can be partially or fully in the middle of a segmented CSA in the folded state (see, e.g., FIG. 3B)).

Figure 23:
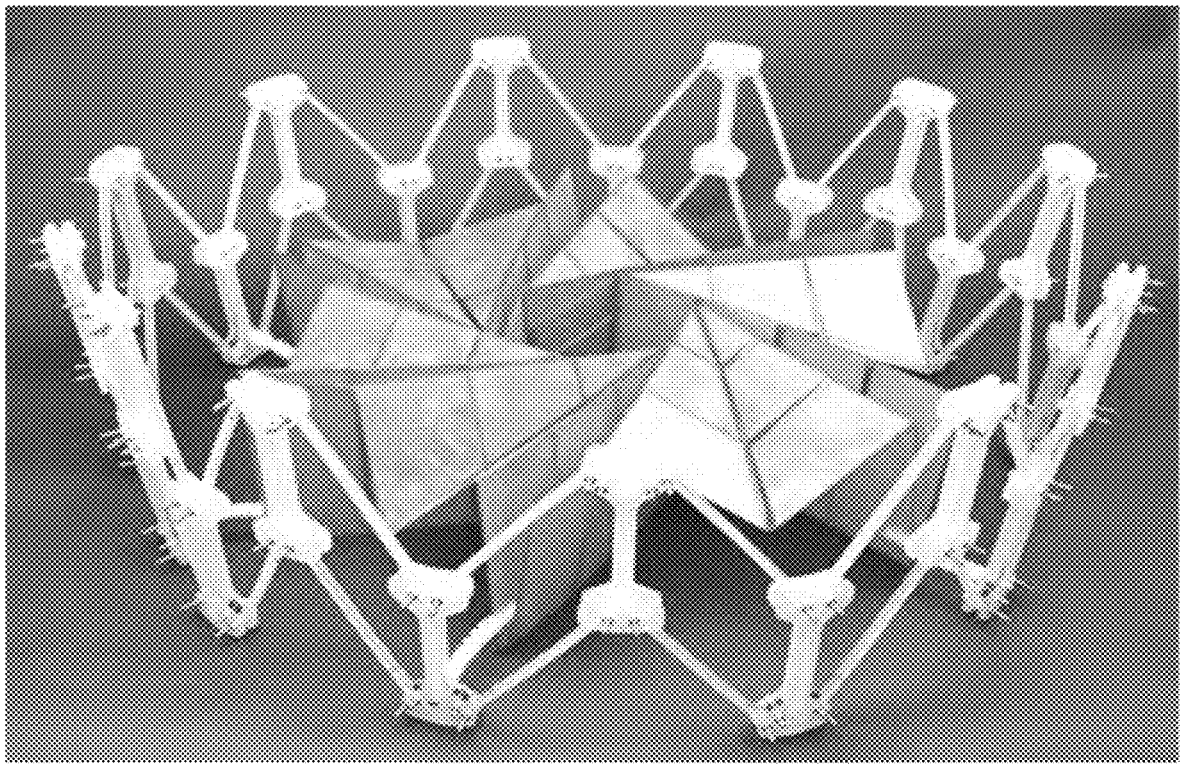
FIG. 23 shows a device with the substrate attached to a framework and an actuator for folding the substrate back and forth between the unfolded state and the fully folded state, the framework surrounding an outer perimeter of the substrate.

In many embodiments, the substrate can be attached to a framework and/or an actuator, which can be used to fold the substrate back and forth between its folded state and unfolded state, as shown in FIG. 23. The actuation system can be compact and easy to operate, which makes the antenna design beneficial for space-borne and satellite applications.

In many embodiments, the substrate can be attached to a framework and/or an actuator, which can be used to fold the substrate back and forth between its folded state and unfolded state. The actuation system can be compact and easy to operate, which makes the antenna design beneficial for space-borne and satellite applications.

FIGS. 13A, 13B, 14A, and 14B show foldable origami antennas with metal traces. Origami antennas have reconfigurable performance by changing physical geometry, including band switching, frequency tuning, beam steering, and polarization adjustment. Origami antennas can be folded to fit in small locations, making them particularly suitable for aerospace applications. In some embodiments of the subject invention, the substrate can be an origami substrate, in particular a rigid and thick origami substrate. A rigid origami structure/substrate advantageously offers a purely geometric mechanism that can be realized at any scale because it does not rely on the elasticity of materials and is not significantly hindered by gravity.

The substrate can be any suitable material known in the art, including but not limited to plastic or FR4 (or other glass epoxy laminate). The substrate can have a thickness of any of the following values, at least any of the following values, about any of the following values, no more than any of the following values, or within any range having any of the following values as endpoints (all values are in millimeter (mm)): 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2, 2.5, 3, 3.5, 4, 4.5, 5, 5.5, 6, 6.5, 7, 7.5, 8, 8.5, 9, 9.5, 10, 11, 12, 13, 14, 15, 16, 17, 18, 19, 20, 21, 22, 23, 24, 25, 25.4, 26, 27, 28, 29, or 30. These values are exemplary only and should not be construed as limiting. Any thickness can be used as long as the substrate can fold without breaking.

The purpose of an origami antenna design is to develop an antenna that is easily deployable and packable with reconfigurable performance. Origami includes: rigidly foldable origami, where stiff panels are folded along hinged creases and creases are geodetically fixed within the pattern; and non-rigidly-foldable origami, where deformation is allowed on each individual face and/or vertices and creases can move within the pattern. Designs of related art origami antennas are based on non-rigidly-foldable origami, which are built with flexible dielectric substrates, such as sketch paper and plastic materials, or with flexible liquid metal alloy 3D printing techniques. Each facet of these models undergoes the surface deformation when the origami antenna is folded and/or unfolded. The thickness of the flexible substrate is negligible compared to the antenna demission, but when the application requires the folding of thick/rigid panels, material thickness can inhibit the folding motion. In these origami antenna designs, extra rigid supporting structures are needed for actuating the non-rigid origami base. Also, these designs would not be able to withstand an environment like space, the desert, or rainy conditions. A rigid/thick origami structure offers a purely geometric mechanism that can be realized at any scale because it does not rely on the elasticity of materials and is not significantly hindered by gravity. The transformation of rigid origami from an unfolded state to a final configuration is controlled by a smaller number of degrees of freedom, which makes the equipment geometry more accurate and repeatable. The thick origami structure also enables more choices for the manufacturing process for origami electromagnetic devices; for example, printed circuit boards (PCBs) can be directly used as facets of the origami model.

A major difficulty that has been encountered is transforming from paper-made origami models to rigid origami models. The origami flasher model, a thickness accommodating mathematical model, can be used for the antenna design. The origami flasher model was developed and presented by Robert Lang et al. in 2013 (S. A. Zirbel, R. J. Lang, S. P. Magleby, M. W. Thomson, D. A. Sigel, P. E. Walkemeyer, B. P. Trease and L. L. Howell, "Accommodating Thickness in Origami-Based Deployable Arrays," Journal of Mechanical Design, vol. 135, no. 111005, pp. 1-11, Nov. 2013); this Lang et al. paper is hereby incorporated by reference herein in its entirety. Every facet of the model is rigid, and the material thickness and spacing between panels can be adjusted.

The CSA is one of the most popular frequency-independent antennas, and it is widely used in space and satellite communications due to its directional circularly polarized radiation performance. Segmented spiral-shaped antennas can provide approximately equivalent performance compared to the conventional spiral/helical antenna, with a lower profile and a simpler manufacturing process. The origami flasher model can wrap a 2-D pattern around a central hub, making it a good candidate for origami segmented CSA design.

One difficulty in developing a non-zero thickness origami structure from a thickness accommodating structure is spacing between layers. The vertices that are physically adjacent to each other need spacing in order for the design to fold. The thickness accommodating origami flasher model allows for spacing in between each layer for better foldability. A coordinate system is established in the Lang et al. paper, based on which the indexed points $p_{i,j,k}$ stand for points in the 2-D creased pattern and $p'_{i,j,k}$ as their respective images in the folded pattern are used to build the origami model. The coordinate system is shown in FIGS. 15A-15C and 16. The indexes i, j, and k are all integers. In general, the central hub of the creased pattern is a regular unit polygon with m sides. The flasher model is a radial symmetrical structure, and the model can be divided into m identical sectors. This numbering scheme gives a unique (i, j) pair to every point within a single sector. Index k specifies the rotational sector that the point belongs to, and $$p_{i,j,k}=p_{i,j,k+m},\ p'_{i,j,k}=p'_{i,j,k+m}. \tag{1}$$

Several functions are defined in the Lang et al. paper in order to derive the coordinate values of $p'_{i,j,k}$. The function rot(i, j) is the number of angular increments (of $2\pi/m$) that the point $p'_{i,j,k}$ gets rotated relative top $p'_{0,0,k}$ (which is the kth corner of the central polygon):

$$\text{rot}\ (i,\ j) \equiv \begin{cases} i+1 & \text{if } i+1 \geq j \\ j & \text{otherwise} \end{cases}. \tag{2}$$

The function ht(i, j) is defined as the discrete (normalized) height of $p'_{i,j,k}$ above the xy plane:

$$ht(i,j) \equiv |(\min(i+1,j)-h)\bmod 2h-h|. \tag{3}$$

The 3D rotation matrix is defined as $$R'(k) \equiv \begin{pmatrix} \cos(2\pi k/m) & \sin(2\pi k/m) & 0 \\ \sin(2\pi k/m) & \cos(2\pi k/m) & 0 \\ 0 & 0 & 1 \end{pmatrix}. \tag{4}$$

Then, the point $p'_{i,j,k}$ has the value $$p'_{i,j,k} = R'(k+\text{rot}(i,\ j)) \times \left[\frac{1}{2}\left(\cot\frac{\pi}{m},\ 1,\ 0\right) + \left(0,\ 0,\ ht(i,\ j)\tan\frac{\pi}{m}\right)\right]. \tag{5}$$

Based on Equation (5), a Mathematica code that sets up the constraints for a general flasher model and solves for vertex coordinates for both the crease pattern and folded form is developed. The code is available for download (R. J. Lang, "Mathematica 8 Notebook," 2012, Available at: http://www.langorigami.com/publication/accommodating-thickness-origami-based-deployable-arrays), and this code is hereby incorporated by reference herein in its entirety. There are five main parameters (m, r, h, dr, dz) that can be tinkered in the mathematical model in order to generate the flasher model fitting the needs of the CSA design.

The parameter m is the rotational order of the flasher model, which equals the number of sides of the central hub. The integer h≥1 is defined as the height order, which is the number of axial bends it takes for the diagonal fold to travel once from the bottom to the top of the cylinder in the folded form. The integer r≥1 is defined as the number of distinct "rings" in the pattern, or equivalently the number of times the diagonal moves from bottom to top and vice versa. The value of j runs from 0 to r×h. The parameter dr has a floating point value, which is the desired separation between two nearest-neighbor vertices at the same radial position, normalized to the diameter of the circumcircle of the central polygon. The parameter dz is also with a floating point value, which is a factor that sets the height of the outermost ring relative to its theoretical (zero-thickness) value.

Figure 1A:
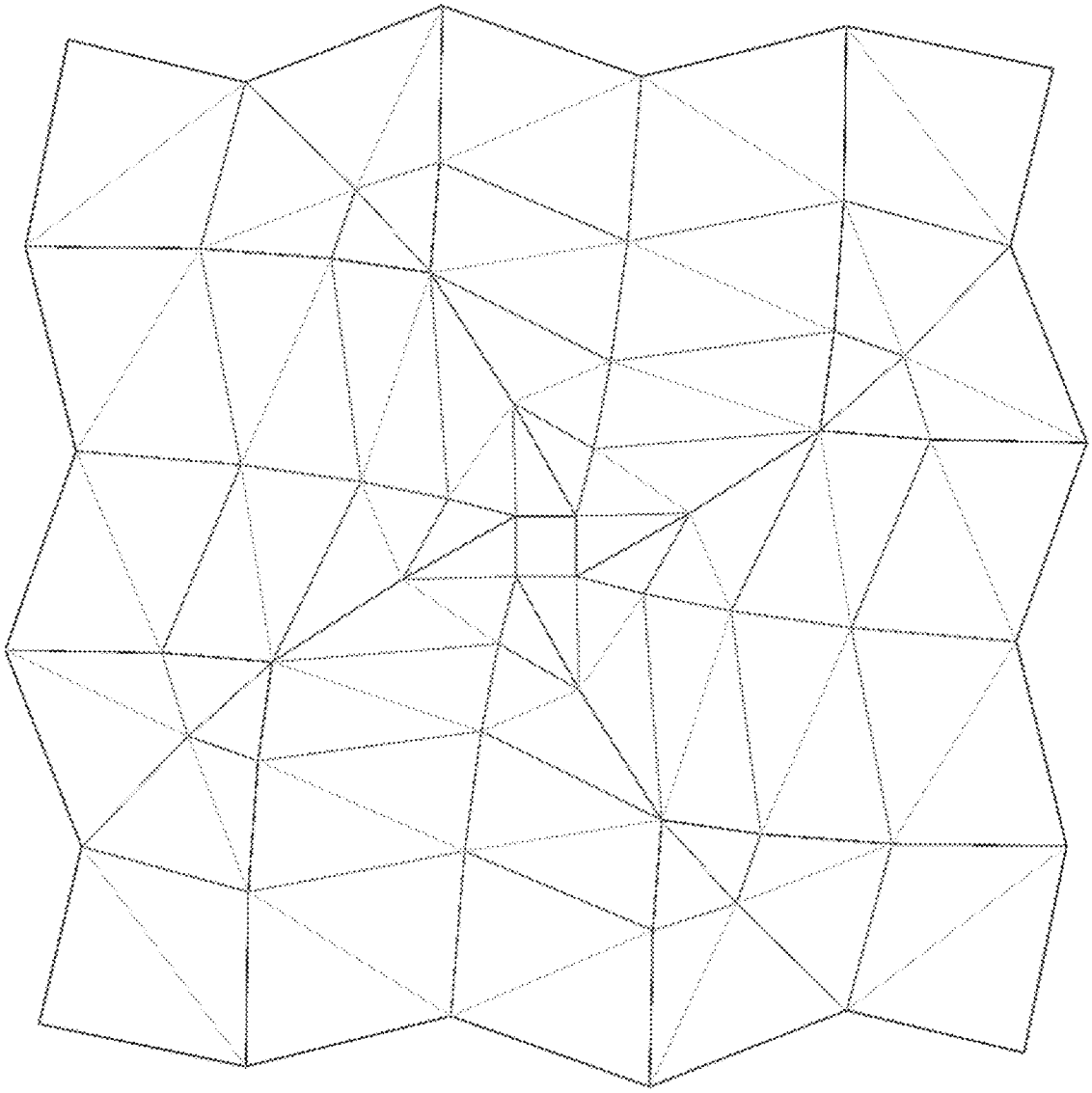
FIG. 1A shows a schematic view of the geometry of a flat origami flasher pattern.
Figure 1B:
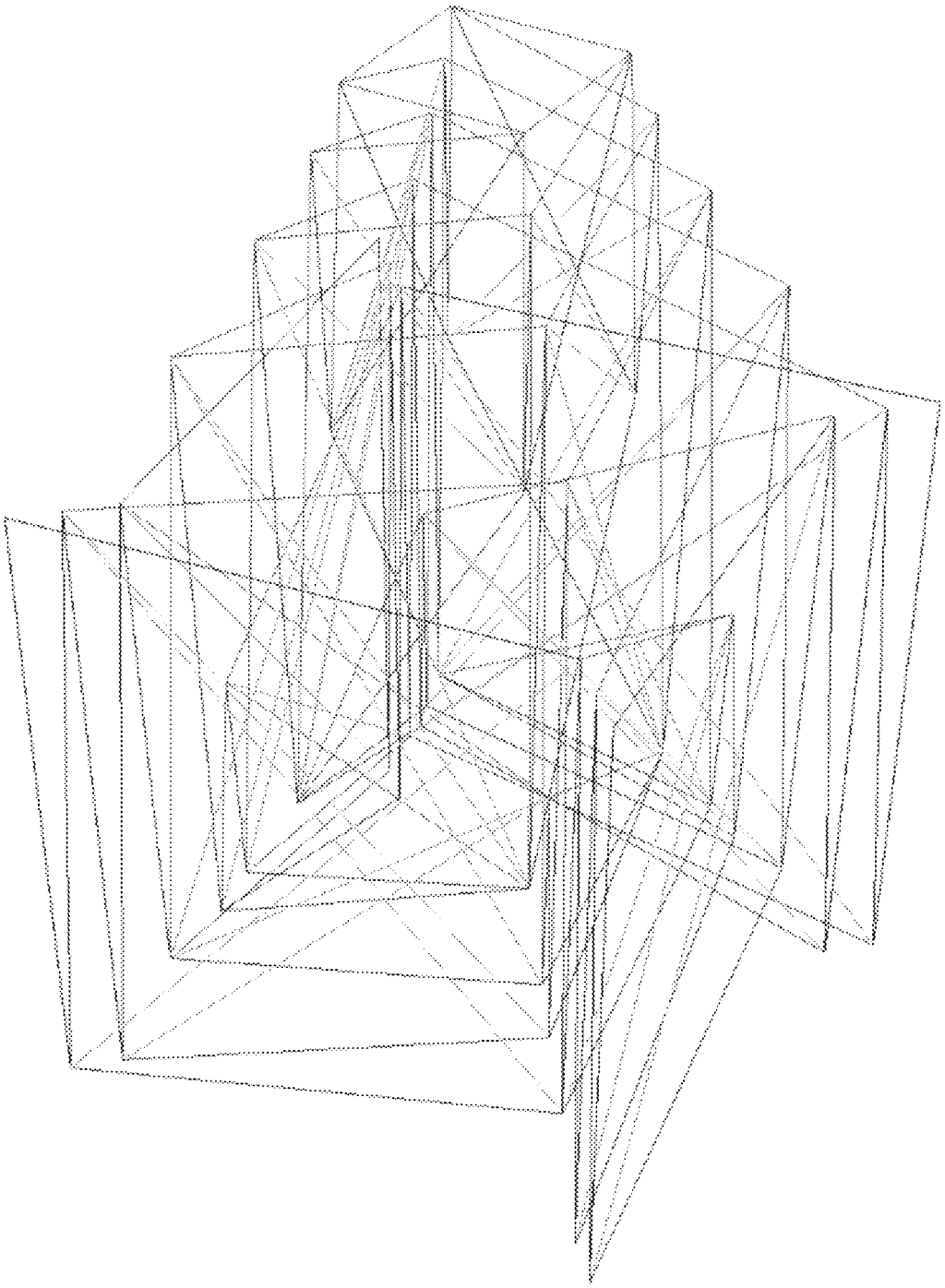
FIG. 1B shows a schematic view of the flasher pattern of FIG. 1A, in a folded state.

FIG. 1A shows the 2D origami flasher pattern for m=4, r=2, h=2, dr=0.15, and dz=0.7, and FIG. 1B shows the corresponding 3D structure at the fully folded state. The origami pattern has a square central hub, with a side length denoted as l. FIGS. 1A and 1B show just one example of an origami shape that can be used with embodiments of the subject invention.

Referring to FIG. 1, the darkest (blue) lines are for valley folds, and the next-darkest (red) interior lines are for mountain folds. The fully folded origami model is a truncated square pyramid shape, and every side of the model is an approximate isosceles trapezoid shape. The half vertex angle, θ, of this pyramid is inversely proportional to the value of dz. The half vertex angle of the folded origami model is approximate 8.8° when m=4, r=2, h=2, dr=0.15, and dz=0.7. Symmetrical metal arms can be put on the pattern around the central hub, as shown in FIG. 2, and after folding the arms can have the conical spiral shape.

In many embodiments, the arrangement of the metal layer area on the origami base follows the two rules: a) the length of each segment of the antenna arm increases exponentially; and b) the metallic area is identical in size and shape with the non-metalized area when the origami structure is fully folded, i.e., the cone has a self-complementary structure. After completing the same steps described by Yao et al. (S. Yao, X. Liu and S. V. Georgakopoulos, "Morphing origami conical spiral antenna based on the nojima wrap," IEEE Trans. Antennas Propagat., vol. 65, no. 5, pp. 2222-2232, 2017), the layout shape of the metal (e.g., copper) layer on the thick origami base is obtained as shown in FIG. 2; the Yao et al. is hereby incorporated by reference herein in its entirety. The filled-in (orange) region in FIG. 2 is the metalized area. The two metal arms emanating from the central hub, which have a bowtie shape starting from the center of the square central hub, are centrosymmetric. Each arm has (1+r×h) segments (the central hub area is not included), and the number of turns, N, of the CSA is:

$$N=(1+r\times h)/m \tag{6}$$

Figure 2:
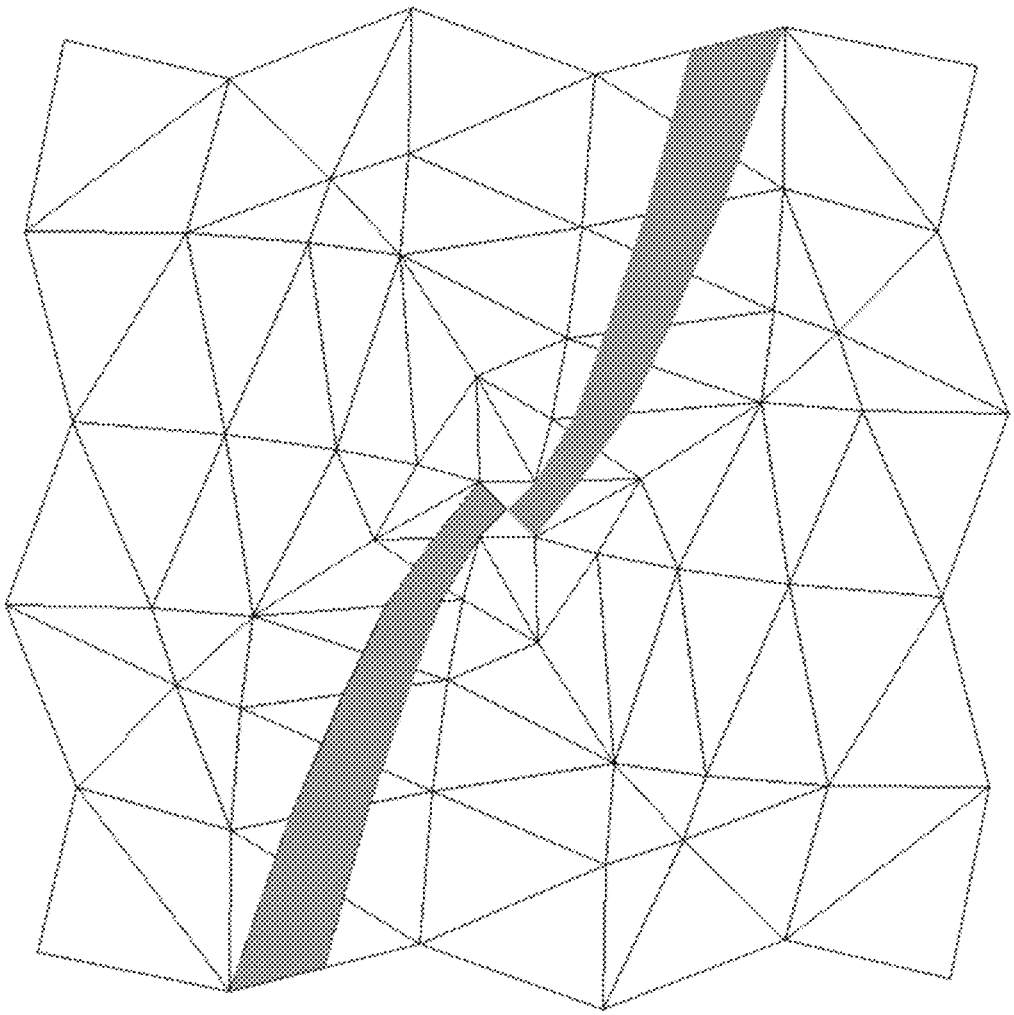
FIG. 2 shows a schematic view of a metal layer on a two-dimensional flat origami flasher pattern according to an embodiment of the subject invention.
Figure 3A:
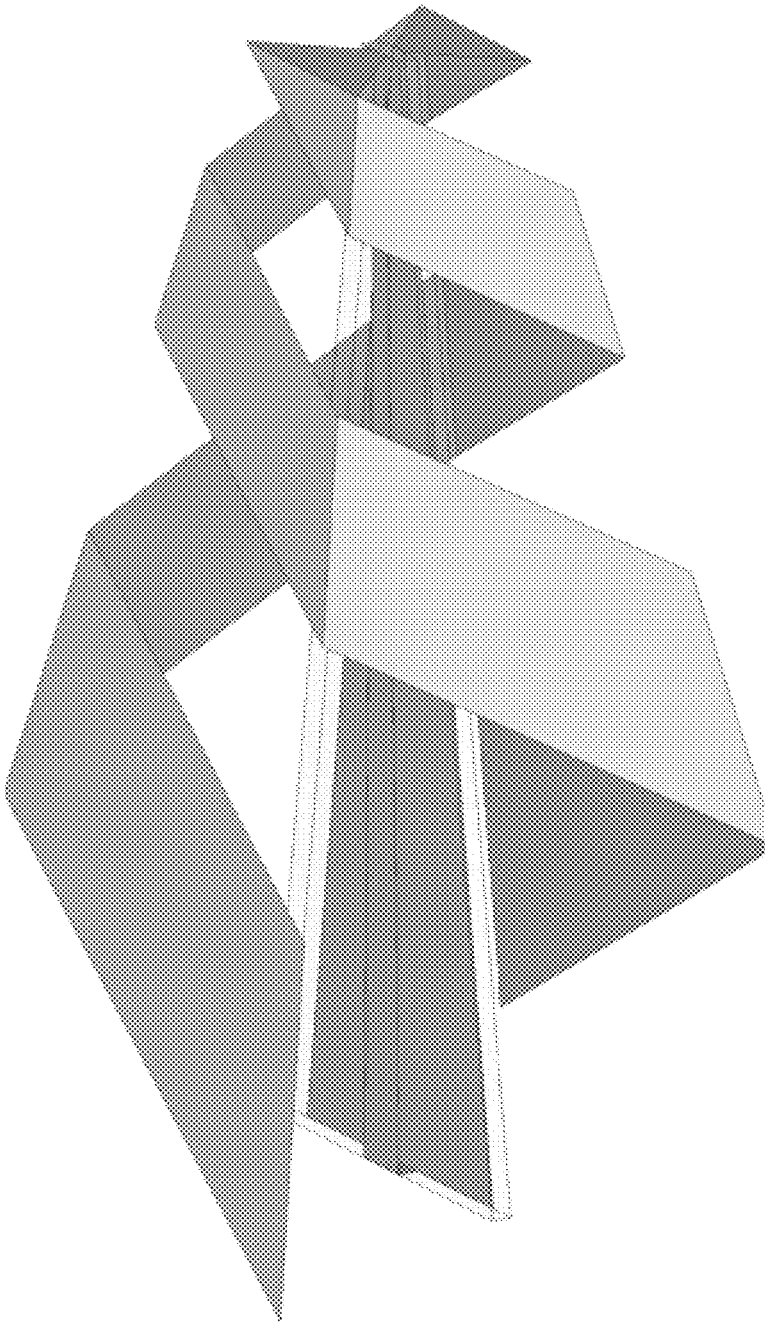
FIG. 3A shows a schematic view of an origami segmented conical spiral antenna (CSA) with a balun, according to an embodiment of the subject invention.
Figure 3B:
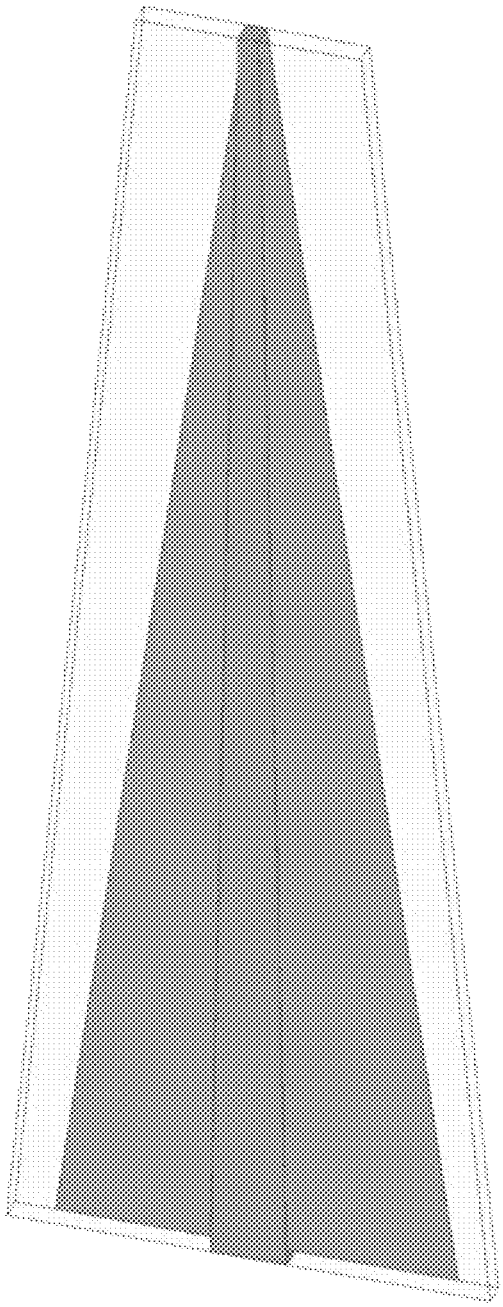
FIG. 3B shows a schematic view of the balun of FIG. 3A.

In the design of FIG. 2, the CSA has N=1.25 turns. The excitation port can be placed between the two arms. After folding the origami base, the two arms can have 3D geometry as shown in FIG. 3A, which is a simulation model from ANSYS HFSS. In order to make the antenna shape clear, the origami base is hidden in FIG. 3A. FIG. 3B shows the balun that is included in the center of the CSA of FIG. 3A.

The bandwidth of related art CSAs is limited by the minimum and maximum diameter of the cone. For a segmented CSA, the bandwidth approximately equals the ratio of the side length of the pyramid bottom to the side length l of the central hub, which also equals the ratio of the maximum radius vector to the minimum radius vector. The horizontal distance between the neighbor vertices along radial position, $D_r$, is $$D_r=dr\times \ell/\sin(\pi/m) \tag{7}$$

where (l/sin(π/m)) is the diameter of the central polygon. In the design of FIG. 3A, l is 15 mm, and $D_r$ is 3.1 mm. The value of $D_r$ should accommodate the thickness of two substrate layers, one metal layer, and one tape layer in this design.

The horizontal distance, $D_h$, between the top corner vertex and the bottom corner vertex in a same sector of the origami flasher model can be derived as $$D_h = dr\times r\times h\times \frac{\ell}{\sin(\pi/m)}. \tag{8}$$

Then, the bandwidth (BW) can be expressed as $$BW\approx 1+dr\times r\times h\times 2 \tag{9}$$

Therefore, the theoretical bandwidth of a CSA when m=4, r=2, h=2, dr=0.15, and dz=0.7, is approximately 2.2.

Figure 5A:
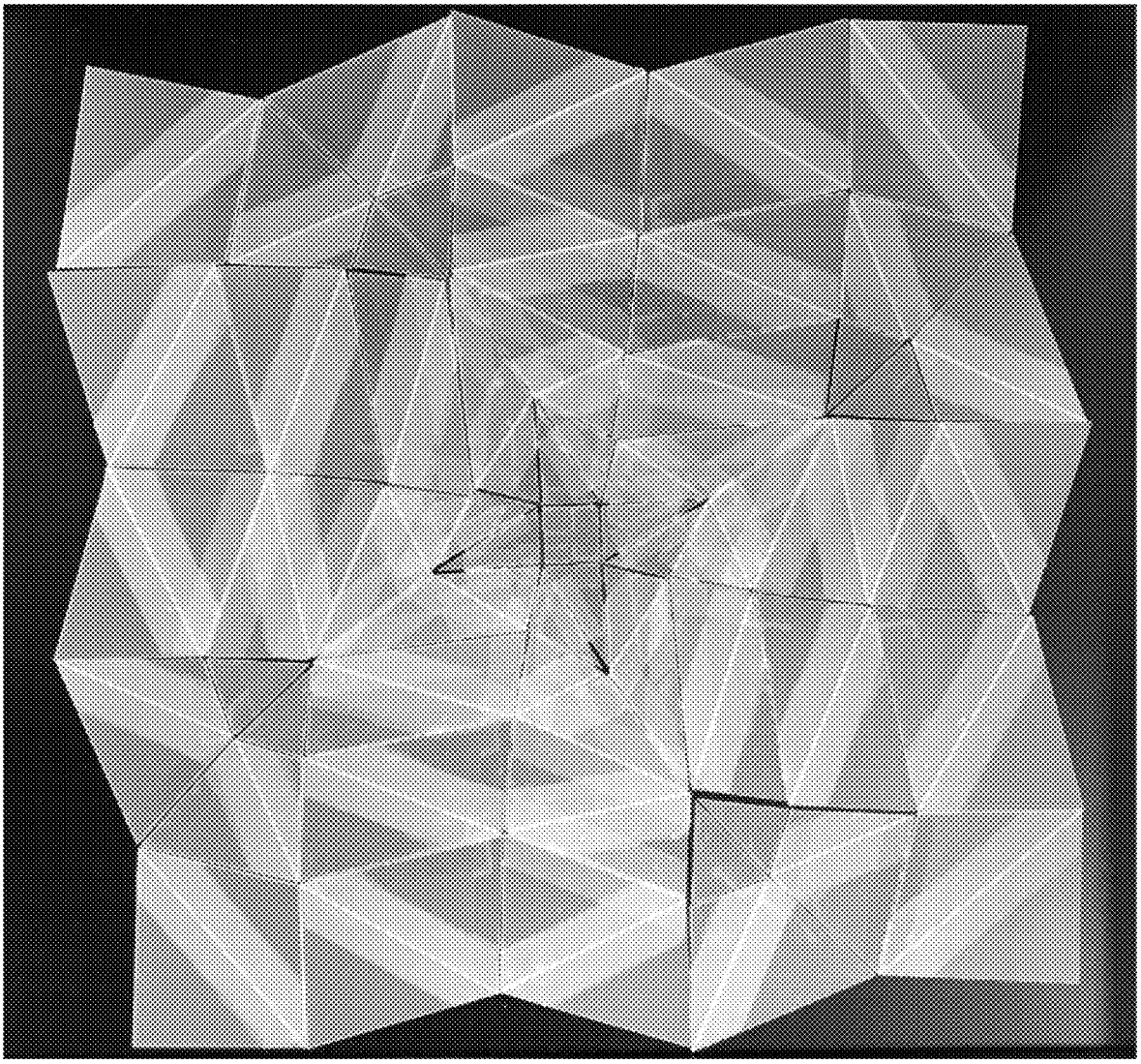
FIG. 5A shows an image of a rigid origami antenna base in an unfolded state, according to an embodiment of the subject invention.

There are at least two options to create the physical model of the flasher pattern base. One option is to allow the panels to fold along their diagonals (the lightest (gray) interior lines in FIG. 1A). Another is to apply a membrane backing to the entire model with specified widths at the fold-lines. When using the first option, all the panels except the central hub can be cut into two triangles. These additional cuts concentrate the flexing occurring in the panels during the folding and unfolding process to be along the diagonal lines. The material can be, for example, a laminate sheet such as an FR4 glass epoxy laminate sheet (e.g., a 0.032 inch-thick FR4 glass epoxy laminate sheet), though embodiments are not limited thereto. FIG. 5A shows an image of an FR4 sheet. The relative permittivity of the base is 4.4. The 8 mm wide polypropylene tapes are used to cover the FR4 origami pattern along the gaps from two sides, i.e., taping on the top side of the gap corresponds to valley-folds (blue-lines in FIGS. 1A and 1B) and taping on the bottom side of the gap corresponds to mountain-folds (red-lines in FIGS. 1A and 1B).

In many embodiments, the substrate can be attached to a framework and/or an actuator, which can be used to fold the substrate back and forth between its folded state and unfolded state as shown in FIG. 23. Several actuation methods and actuators for the deployment of foldable substrates are described in Zirbel et al. (S. A. Zirbel, B. P. Trease, S. P. Magleby and L. H. Howell, "Deployment methods for an origami-inspired rigid-foldable array," in Energy Production and Conversion: Mech. Eng., May 1, 2014. pp. 189-194), which is hereby incorporated by reference herein in its entirety. Any of the actuators/actuation methods described in Zirbel et al. can be used with a foldable substrate of an embodiment of the subject invention. The actuation system can be compact and easy to operate, which makes the antenna design beneficial for space-borne and satellite applications.

Reconfigurable foldable segmented CSAs of embodiments of the subject invention can be based on a rigid-foldable pattern/substrate. The antenna can work as omnidirectional linearly polarized dipole in an unfolded state and a directional circularly polarized broadband antenna in a folded state. The segmented CSA can exhibit large bandwidth (for example, 1.76 bandwidth (2.1-3.7 GHz), though embodiments are not limited thereto). Segmented CSAs can be fabricated using a rigid substrate.

Embodiments of the subject invention provide rigid, foldable or origami-based, antennas. A two dimensional (2D) foldable pattern can be folded into a three dimensional (3D) structure, such as a symmetrical 3D multilateral conical structure. An omnidirectional linearly polarized dipole antenna (unfolded state) can transform itself into a directional circularly polarized broadband antenna (e.g., segmented CSA). Foldable antennas with rigid panels can change their geometrical shape in order to change their antenna radiation characteristics, such as radiation pattern, bandwidth, beamwidth, and directivity, thereby providing multi-functionality (i.e., one antenna can serve multiple services and applications). Antennas of embodiments of the subject invention are suitable for spaceborne and airborne applications as they are deployable, packable, and have multifunctional performance. Such antennas are also very well suited for tactical antennas, field antennas, and portable antennas. Foldable antennas with rigid panels can be built using thick, rigid (i.e., capable of being bent but not flexible) substrates (e.g., printed circuit boards) providing robust and reconfigurable operation through a large number of folding/unfolding (i.e., collapsing/deploying) cycles. Various types of hinges can be used to connect panels (e.g., substrates or portions of the same substrate) to each other. Various materials can be used to provide electrical connection across hinges, including but not limited to flexible conductors, liquid metals, textiles, and polymers integrated with stretchable conductors. Foldable antennas with rigid panels offer a purely geometric mechanism that can be realized at any scale because it does not rely on the elasticity of materials and is not significantly hindered by gravity.

A greater understanding of the embodiments of the subject invention and of their many advantages may be had from the following examples, given by way of illustration. The following examples are illustrative of some of the methods, applications, embodiments, and variants of the present invention. They are, of course, not to be considered as limiting the invention. Numerous changes and modifications can be made with respect to the invention.

Example 1

A foldable antenna was fabricated on a rigid substrate, as shown in FIGS. 2-3B. That is, the flasher pattern of FIGS. 1A-1B was used as the substrate, and a metal layer as shown in FIG. 2 was formed thereon. The substrate was foldable to the form shown in FIG. 3A, and it had a balun as shown in FIGS. 3A and 3B.

Figure 4:
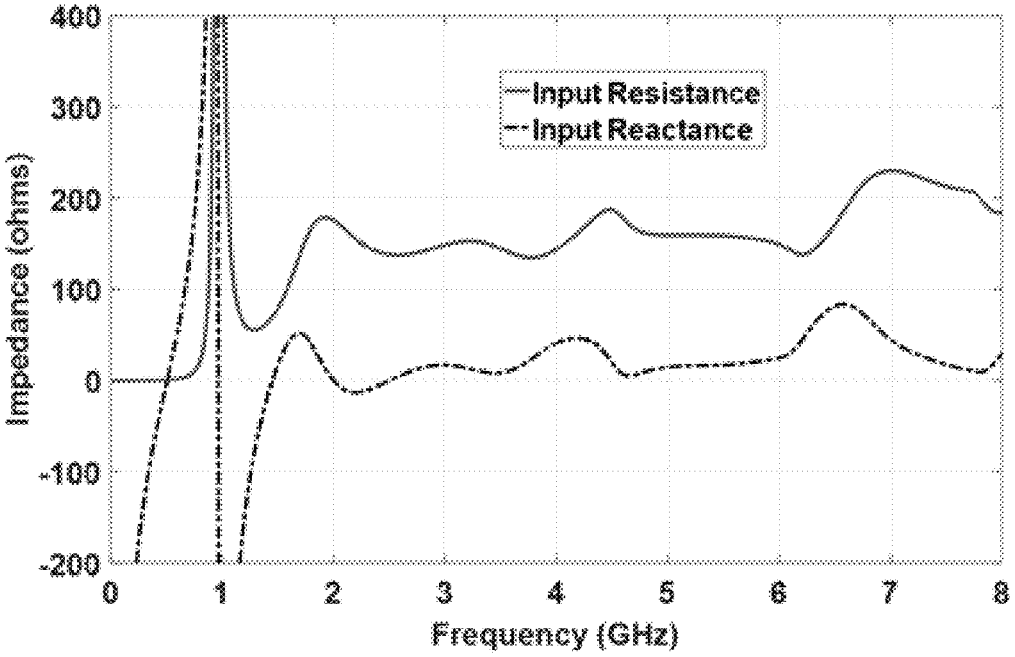
FIG. 4 shows a plot of input impedance (in Ohms (a)) versus frequency (in gigahertz (GHz)) for an origami segmented CSA.

FIG. 4 shows the simulated input impedance (in Ohms (Ω)) versus frequency (in gigahertz (GHz)) for the segmented CSA when the lumped port was excited at the center of the central hub, between the ends of two CSA arms. Referring to FIG. 4, the input impedance of the rigid origami CSA has broadband performance. The resistance was approximately 135Ω from 2.1 GHz to 3.7 GHz. The range of reactance was from −10Ω to 10Ω in that frequency band. A microstrip balun was used to match the impedance of the foldable segmented CSA to 50Ω. The balun structure was totally inside the folded antenna, as shown in FIGS. 3A and 3B. Rogers R05880 with 2.2 relative permittivity was used as the substrate material of the balun. The substrate thickness was 1.5 mm, and the widths of the top ends of the copper trace on the two sides of the balun were both 1.56 mm. The width of the bottom ends of the copper trace on the two sides of the balun were 4.75 mm and 25 mm, respectively.

Figure 5B:
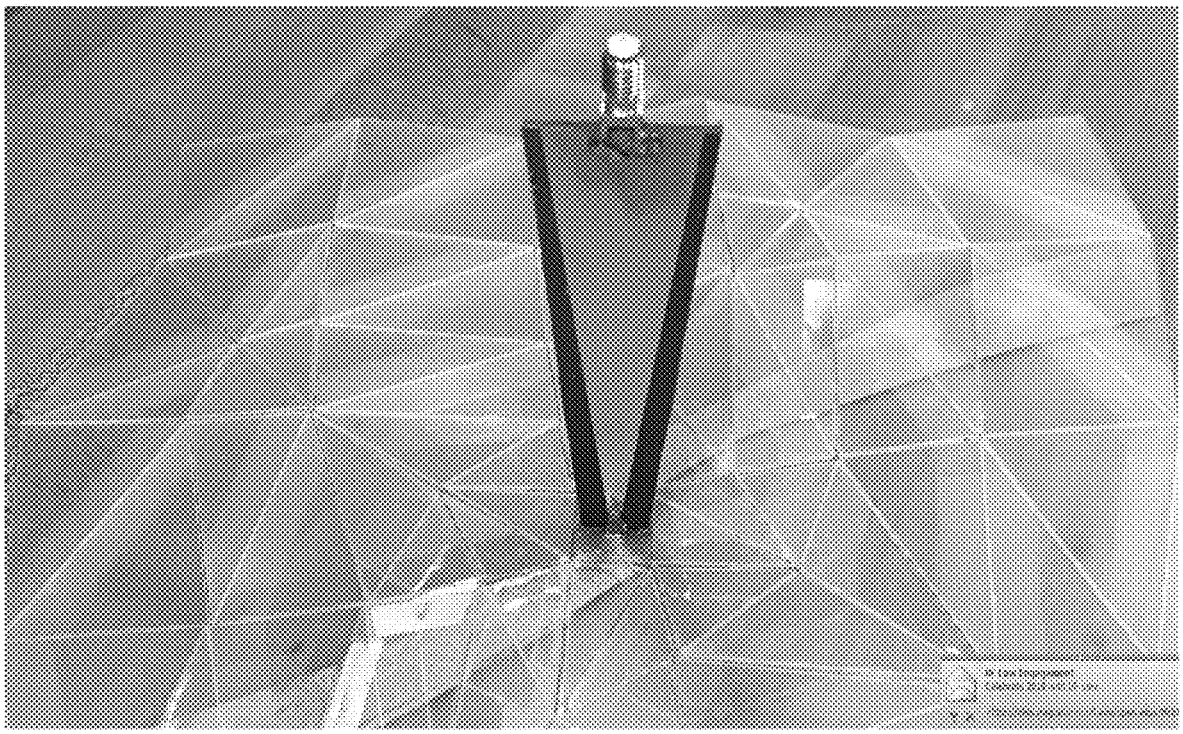
FIG. 5B shows an image of the backside of the antenna base of FIG. 5A, along with a micro-strip balun.

The two CSA arms were constructed using 0.1 mm thick copper tape. The copper tape used for the metal layer was glued on the FR4 base (substrate) and stayed attached to the substrate when the antenna was being folded and unfolded. An extra length of 1.2 mm was kept when the copper layer crossed the mountain-folds. The winding direction of the copper arms was right-handed and therefore the sense of rotation of the circularly polarized field of the origami CSA was right-handed. Two slots were cut on the central hub of the FR4 substrate, allowing the copper tape to pass through. The copper tape was soldered at the output of the balun at the bottom side of the substrate, as shown in FIG. 5B. A 50Ω SMA (sub-miniature version A) connector was soldered at the input side of the balun.

Figure 6:
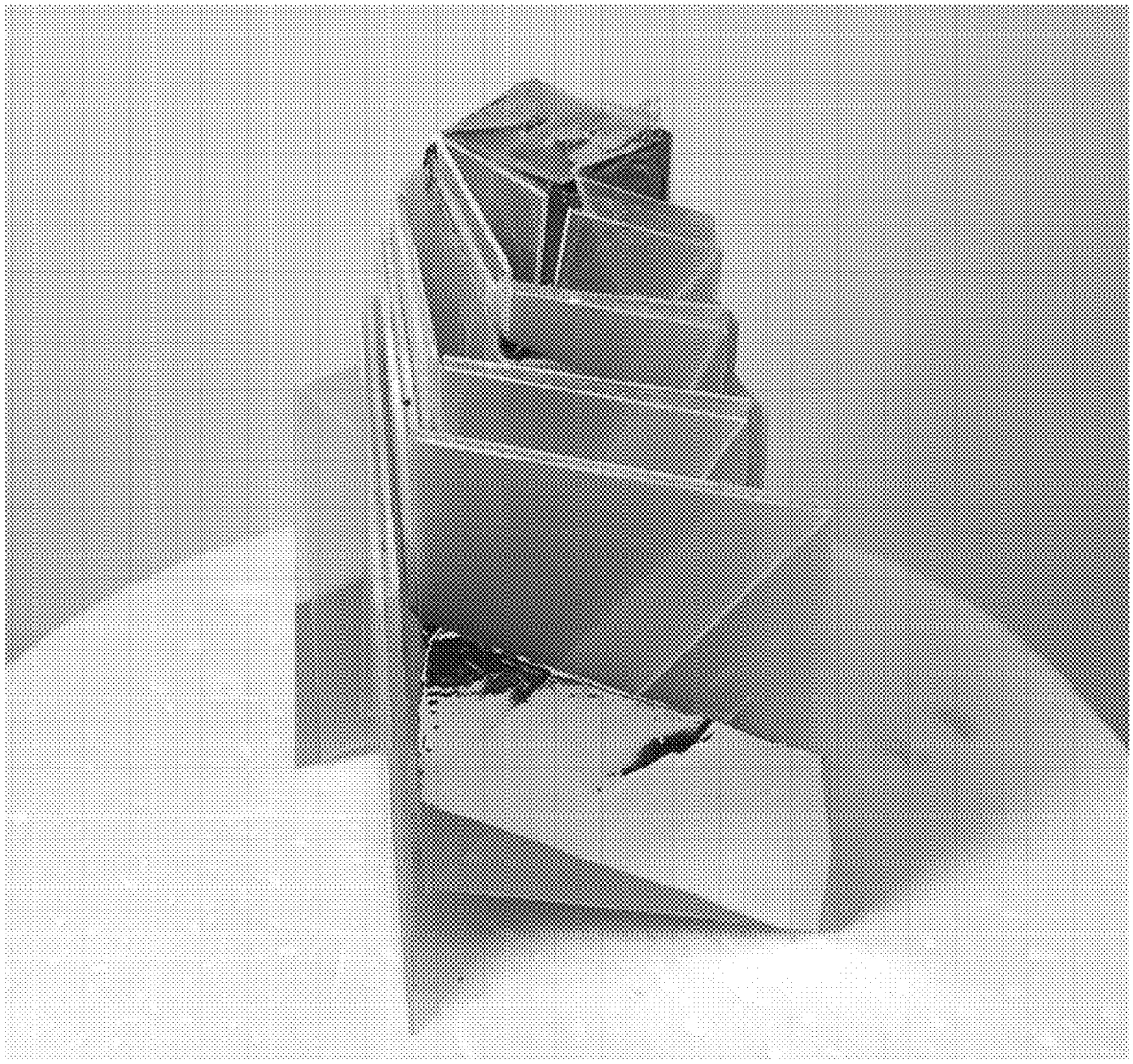
FIG. 6 shows an image of a folded origami segmented CSA, according to an embodiment of the subject invention.

FIG. 6 shows an image of the manufactured antenna in the folded state. The state shown in FIG. 6 is not the mathematical fully folded origami model, because the gap distance between the neighbor layers is large. Paper tapes were used to surround the folded antenna in the measurements, in order to make the structure tight (i.e., to make the gap distance between layers as close to zero as possible). Antenna performance was simulated and measured.

Figure 7:
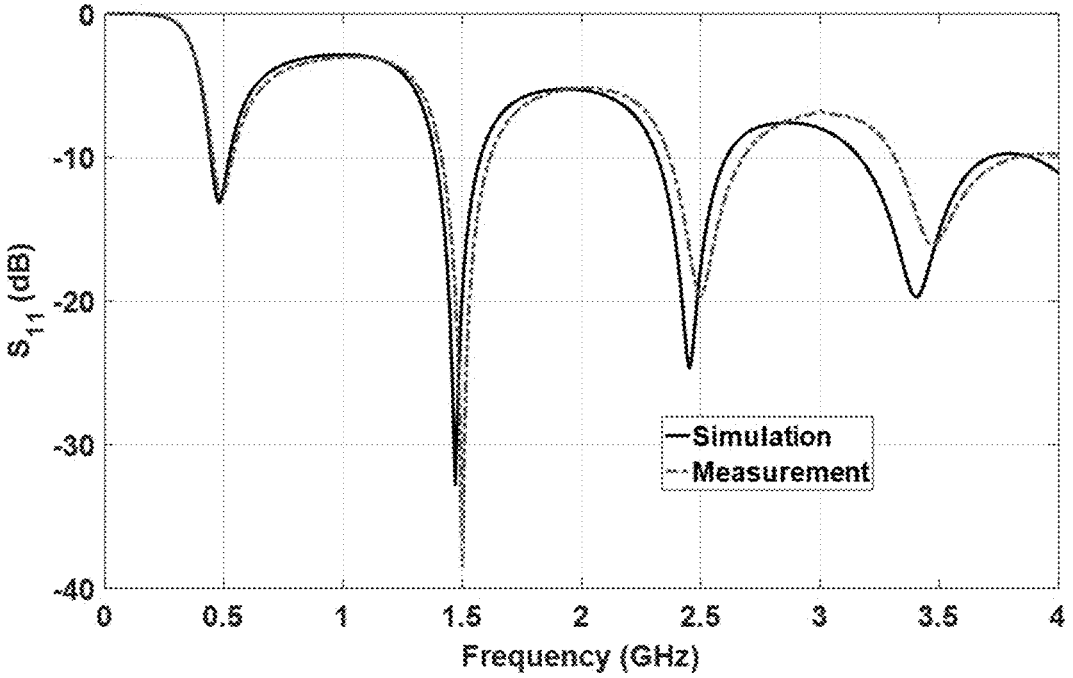
FIG. 7 shows a plot of $S_{11}$ (in decibels (dB)) versus frequency (in GHz) for an origami segmented CSA in an unfolded state.
Figure 20A:
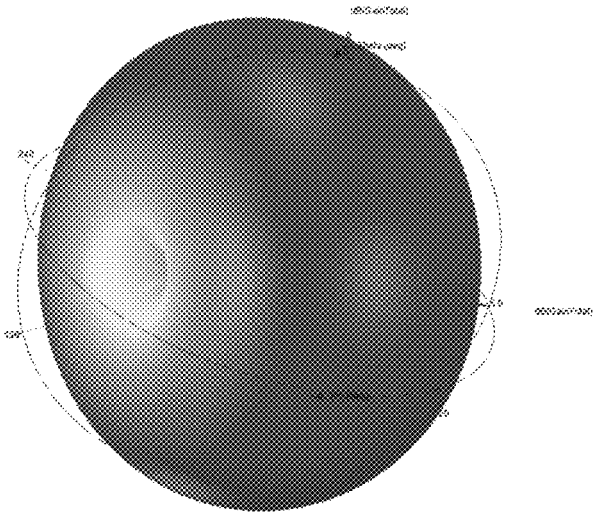
FIG. 20A shows the radiation pattern from FIG. 7 at a frequency of just less than 0.5 GHz.
Figure 20B:
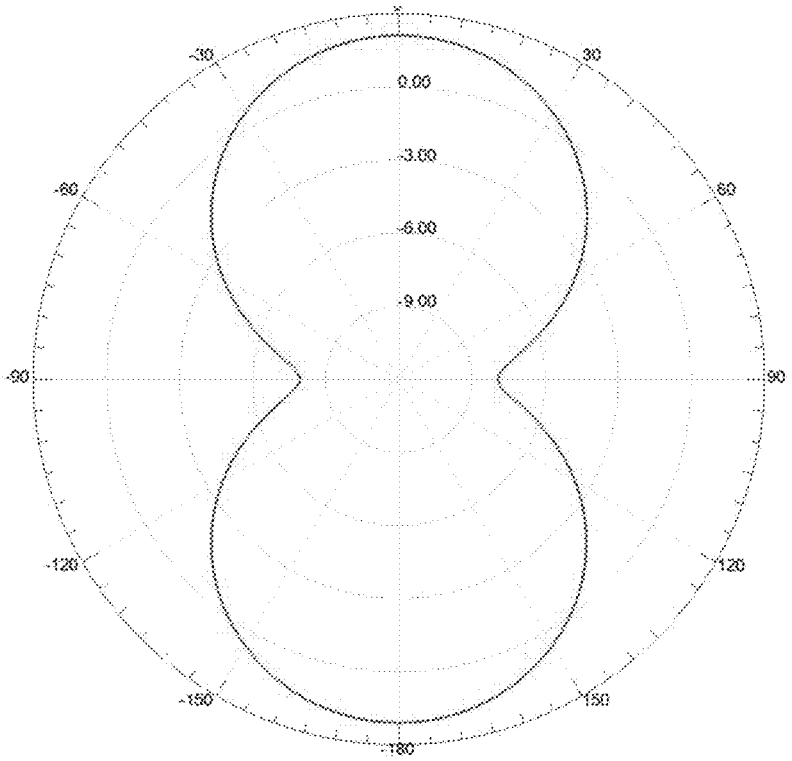
FIG. 20B shows the elevation pattern for the electric field, which goes along with FIGS. 7 and 20A.

FIG. 7 shows a plot of reflection coefficient ($S_{11}$) (in decibels (dB)) versus frequency (in GHz) for the segmented CSA in an unfolded state, with a flat substrate base. The origami antenna operates as a planar half-wavelength dipole at the unfolded state. The length of each metal arm was approximately 154 mm. The measured $S_{11}$ agreed well with the simulation. The antenna exhibited omnidirectional far field performance at 0.7 GHz resonant frequency. The measured realized gain for the unfolded origami antenna was 1.76 dB. FIG. 20A shows the radiation pattern for the antenna at a frequency of just less than 0.5 GHz. FIG. 20B shows the elevation pattern for the electric field, which goes along with FIGS. 7 and 20A.

Figure 8:
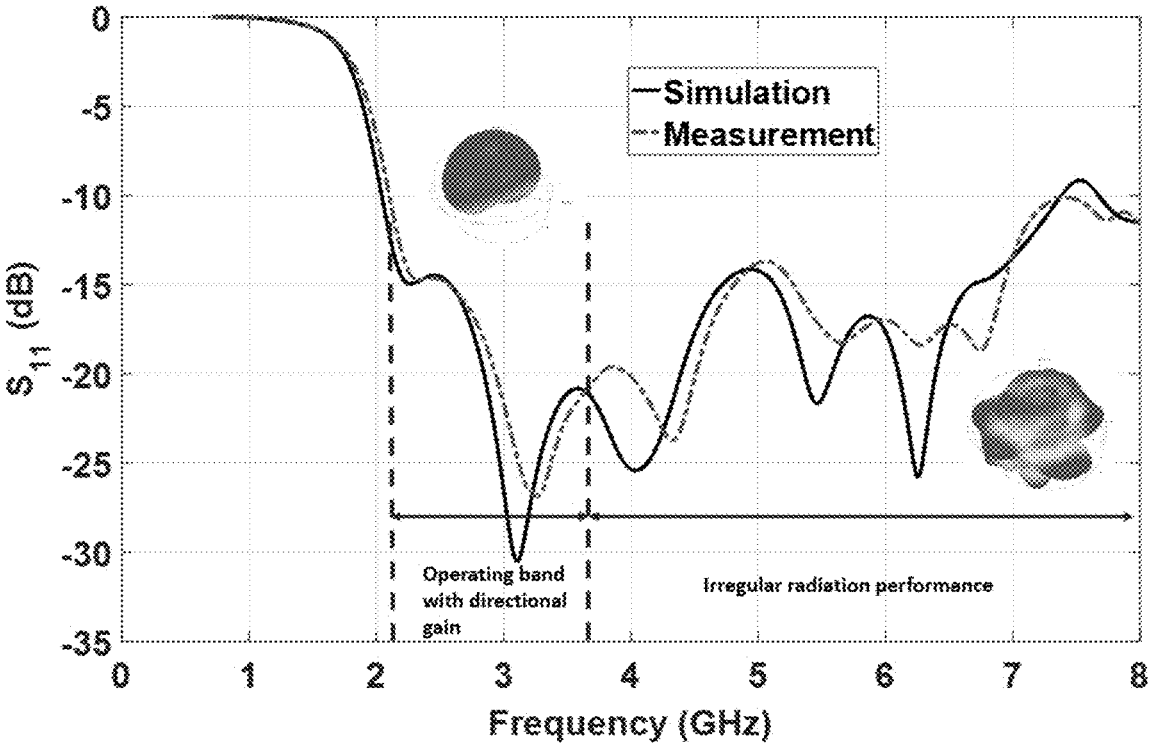
FIG. 8 shows a plot of $S_{11}$ (in dB) versus frequency (in GHz) for an origami segmented CSA in a folded state.

FIG. 8 shows a plot of simulated and measured reflection coefficient ($S_{11}$) of the segmented CSA at the fully folded state. The results show that the $S_{11}$ is below −10 dB after 2.1 GHz for both simulation and measurement. The disagreement between the measured and simulated reflection coefficient of the fully folded antenna can be attributed to the fact that the simulation folded model is an ideal truncated pyramid shape, which was not exactly realized by the physical antenna in this case. Also, the tape layer was not included in the simulation model.

Figure 21:
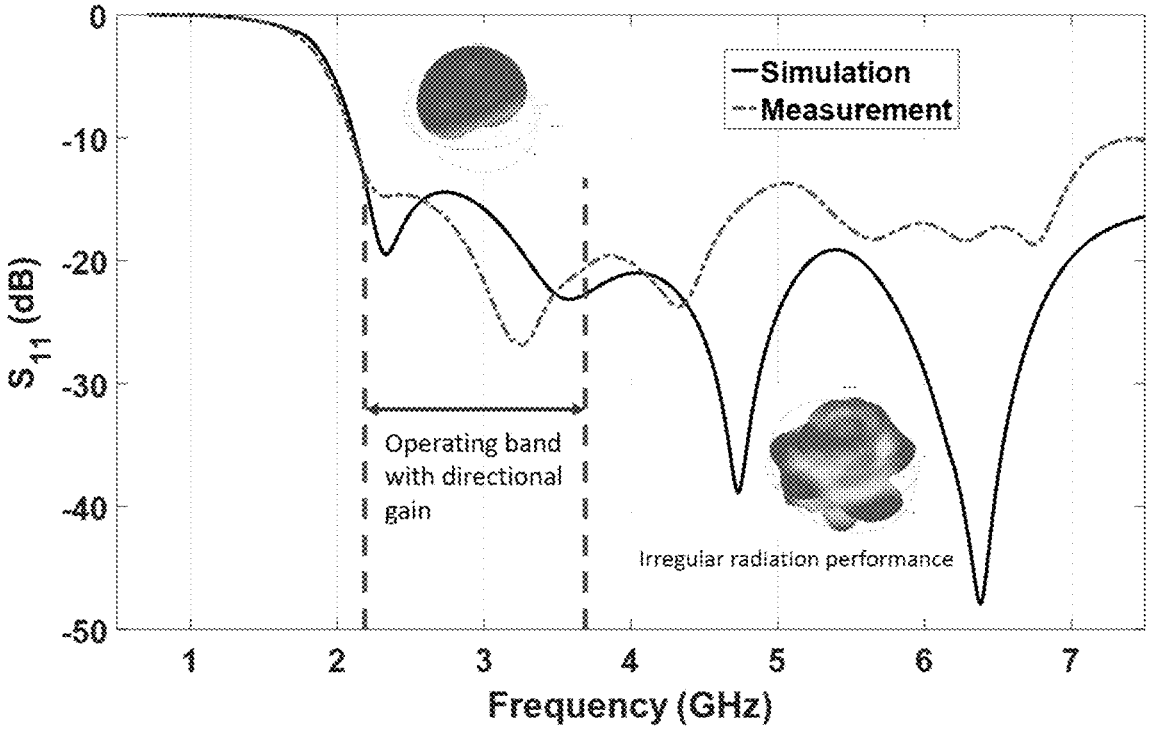
FIG. 21 shows a plot of S11 (in dB) versus frequency (in GHz) for an origami segmented CSA in a folded state.
Figure 22A:
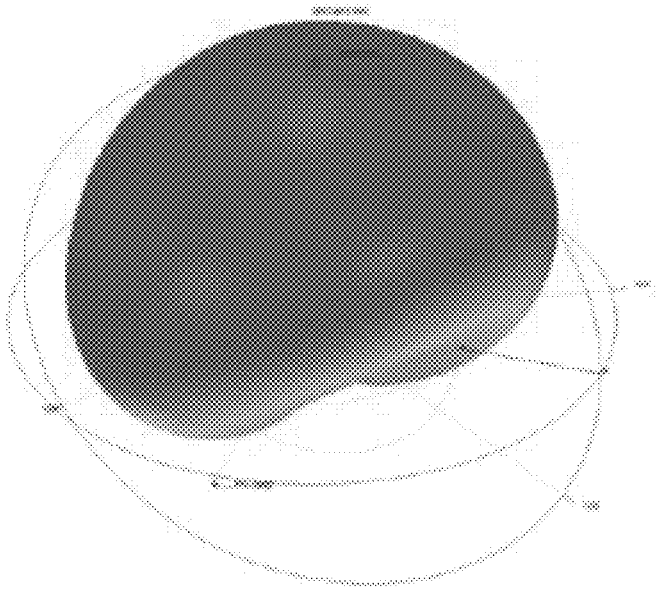
FIG. 22A shows the radiation pattern at 2.5 GHz for the CSA used for FIG. 21.
Figure 22B:
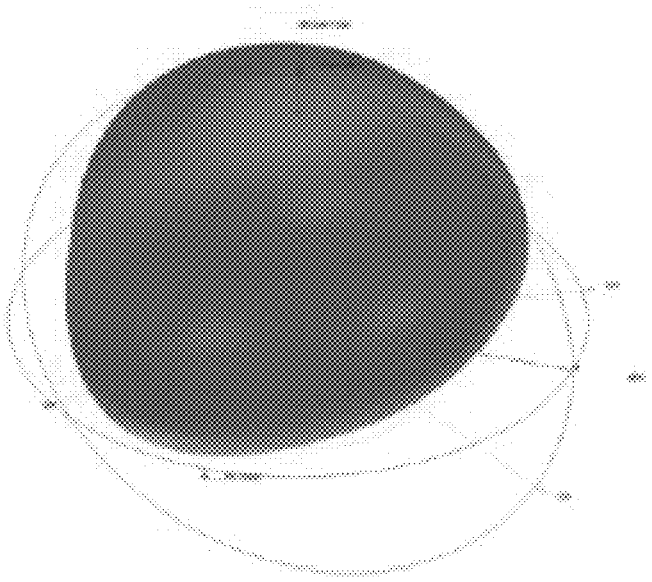
FIG. 22B shows the radiation pattern at 3.5 GHz for the CSA used for FIG. 21.

FIG. 21 shows a plot of simulated and measured reflection coefficient ($S_{11}$) (in dB) versus frequency (in GHz) for another set of simulations and measurements for the origami segmented CSA in a folded state. FIG. 22A shows the radiation pattern at 2.5 GHz for the experiment used for FIG. 21. FIG. 22B shows the radiation pattern at 3.5 GHz for the experiment used for FIG. 21.

Figure 9:
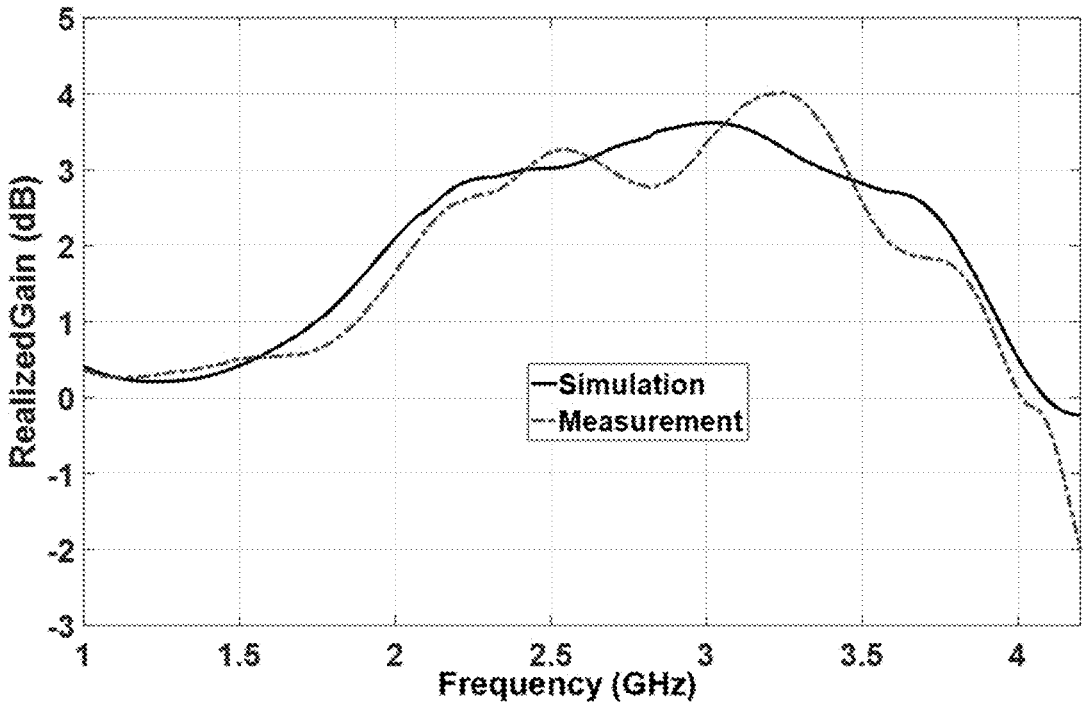
FIG. 9 shows a plot of realized gain (in dB) along the +z direction versus frequency (in GHz) for an origami segmented CSA in a folded state.
Figure 10A:
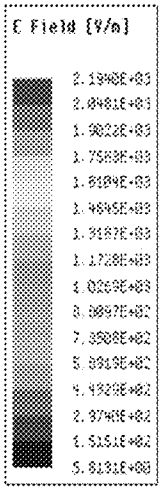
FIG. 10A shows surface current distribution of the origami segmented CSA of FIG. 6, in a folded state, at a frequency of 2.5 GHz.
Figure 10A:
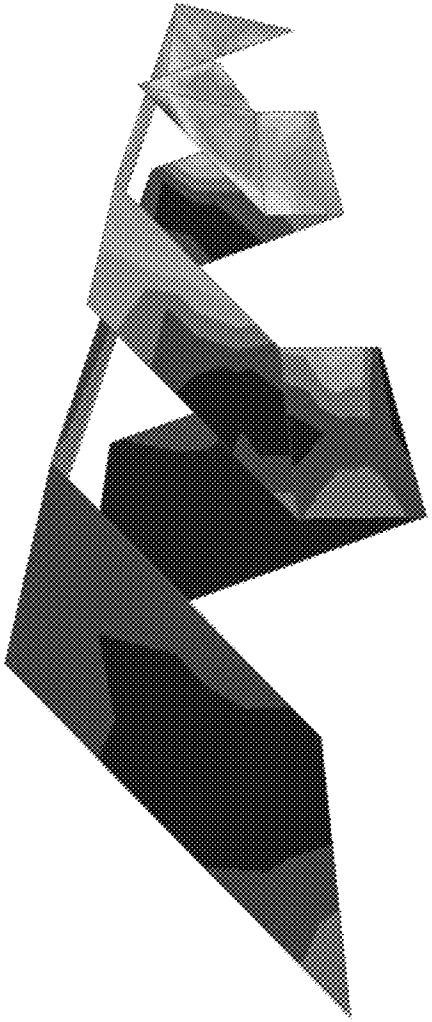
Figure 10B:
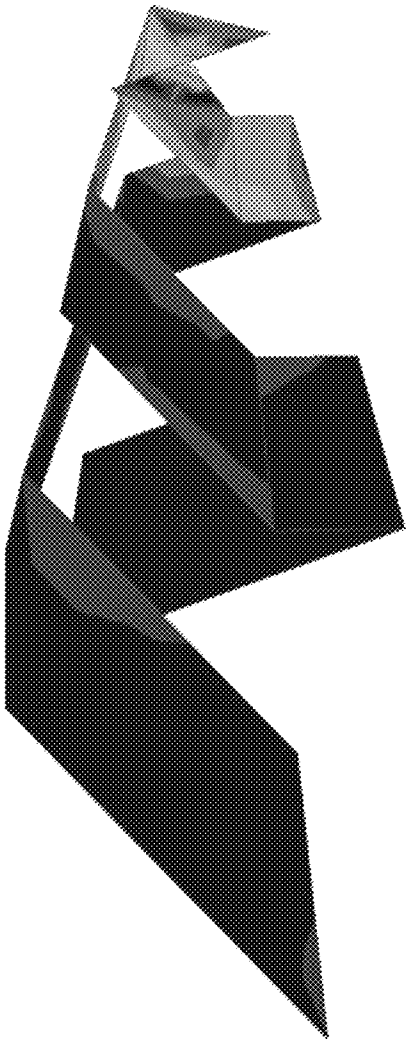
FIG. 10B shows surface current distribution of the origami segmented CSA of FIG. 6, in a folded state, at a frequency of 3.5 GHz.
Figure 10C:
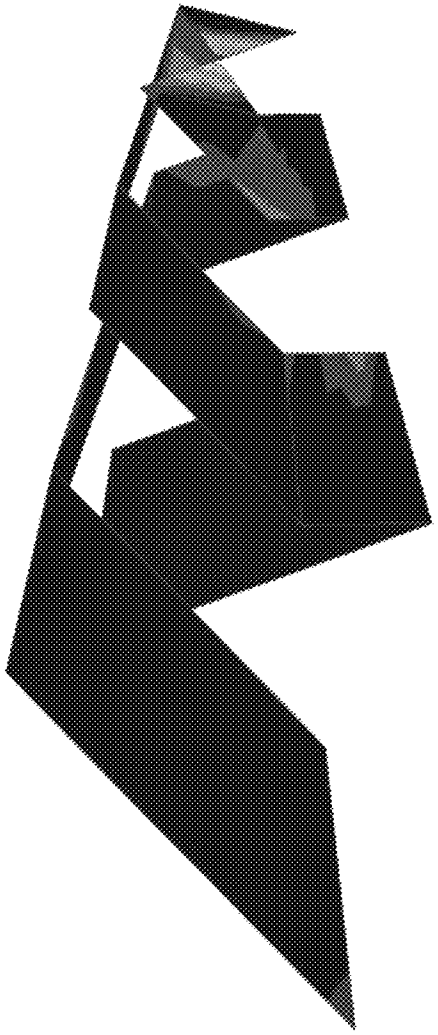
FIG. 10C shows surface current distribution of the origami segmented CSA of FIG. 6, in a folded state, at a frequency of 4 GHz.

FIG. 9 shows a plot of realized gain (in dB) along the central axis direction (+z direction) versus frequency (in GHz) for the segmented CSA in the folded state. The antenna was measured in a StarLab anechoic chamber. The results illustrate that the simulated realized gain of the origami segmented CSA was larger than 2 dB from 2 GHz to 3.8 GHz, and the measured realized gain was larger than 2 dB in the frequency band 2.1 GHz to 3.6 GHz. The reflection coefficient of the folded antenna being low at higher frequency was due to the bowtie shape of the copper layer at the central hub. However, the radiation pattern became irregular above 3.7 GHz in both simulation and measurement, and that was because the current only distributes at the central hub area in that frequency range, as shown in FIG. 10C. Therefore, the realized gain fell rapidly in the frequency band higher than 3.7 GHz. Referring to FIGS. 10A-10C, the area with high current density was directly proportional to the wavelength of the operating frequency, which is consistent with expected CSA performance.

Figure 11:
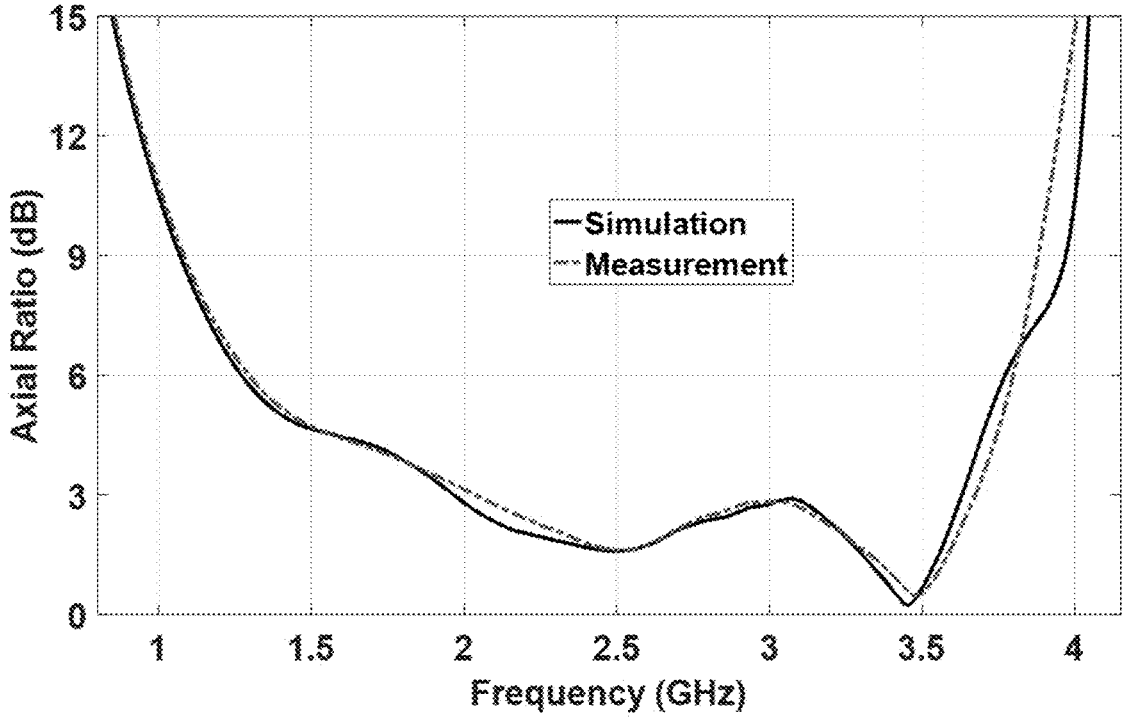
FIG. 11 shows a plot of realized gain axial ratio (in dB) along the +z direction versus frequency (in GHz) for an origami segmented CSA in a folded state.

The operating frequency band of the folded antenna with directional far-field radiation performance was approximately 2.1 GHz to 3.7 GHz. The measured radiation efficiency was from 61% to 66% in the operating frequency band. The radiation efficiency is related to the substrate material; for example, the efficiency can be improved with a Rogers origami base. The simulated and measured axial ratio of the segmented CSA at zenith is shown in FIG. 11. The measured axial ratio was below 3 dB in the frequency band of 2.1 GHz to 3.7 GHz, which agreed with the simulation results. This shows that the folded antenna (i.e., segmented CSA) is circularly polarized, which also confirms its broadband operation.

Figure 12A:
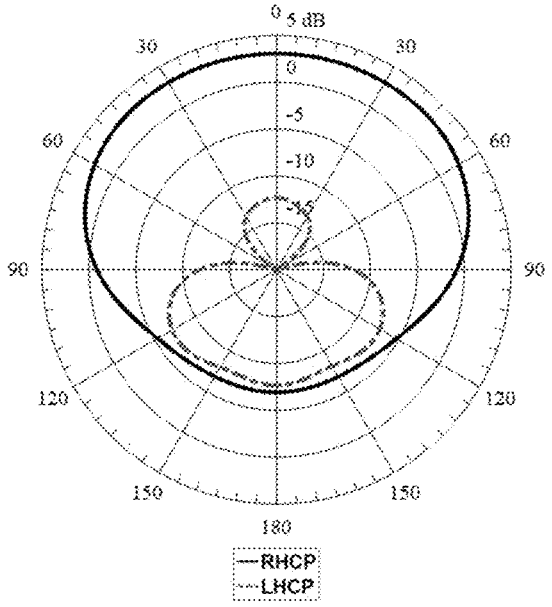
FIG. 12A shows an elevation pattern for the right-handed and left-handed circularly polarized components of the electric field for an origami segmented CSA, with $\varphi=0°$ and a frequency of 2.5 GHz.
Figure 12B:
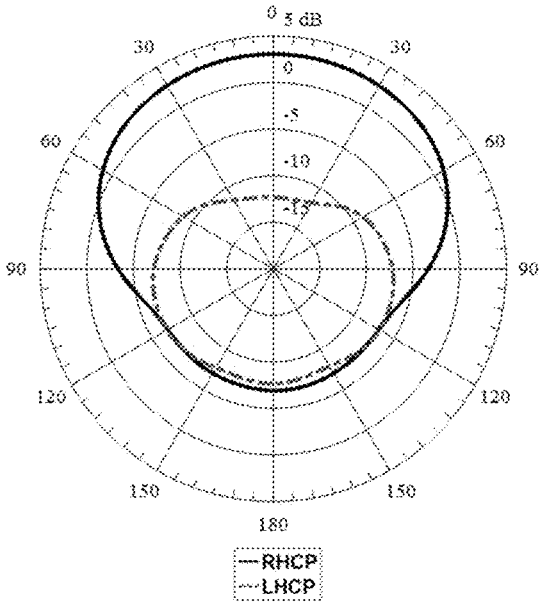
FIG. 12B shows an elevation pattern for the right-handed and left-handed circularly polarized components of the electric field for an origami segmented CSA, with $\varphi=90°$ and a frequency of 2.5 GHz.
Figure 12C:
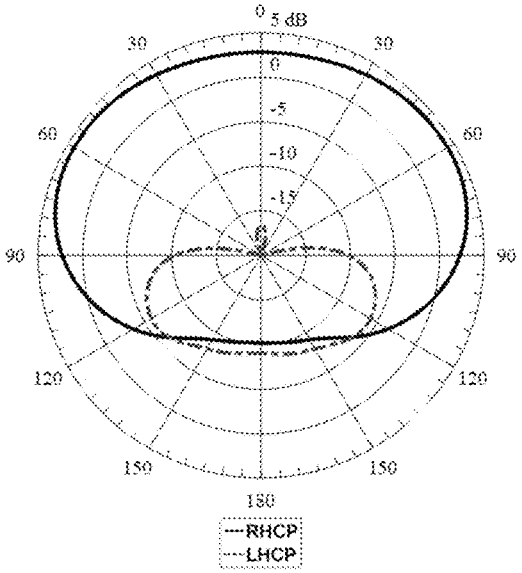
FIG. 12C shows an elevation pattern for the right-handed and left-handed circularly polarized components of the electric field for an origami segmented CSA, with $\varphi=0°$ and a frequency of 3.5 GHz.
Figure 12D:
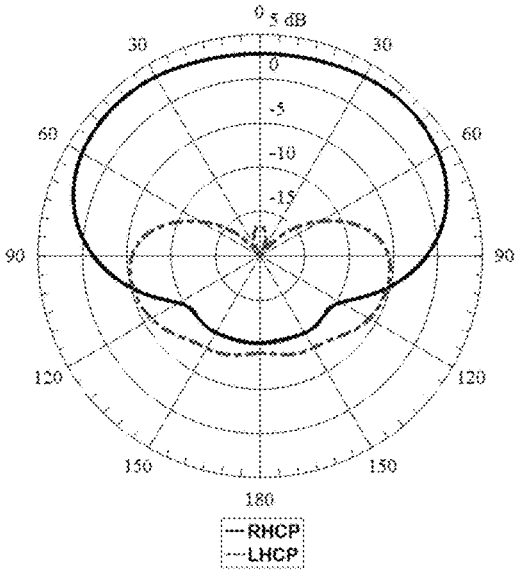
FIG. 12D shows an elevation pattern for the right-handed and left-handed circularly polarized components of the electric field for an origami segmented CSA, with φ=90° and a frequency of 3.5 GHz.
Figure 13A:
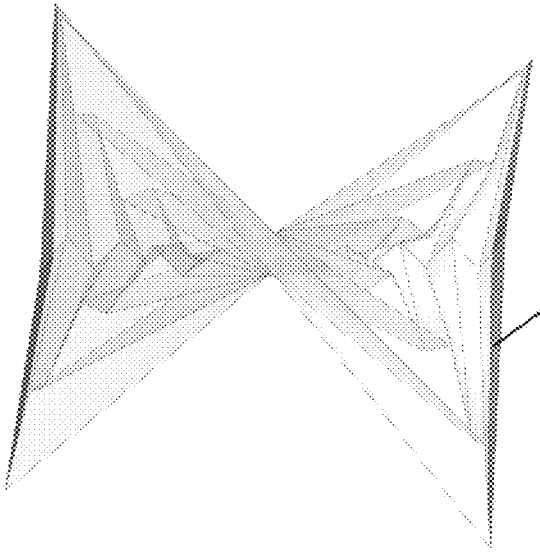
FIG. 13A shows a schematic view of a foldable origami antenna with a metal trace.
Figure 13B:
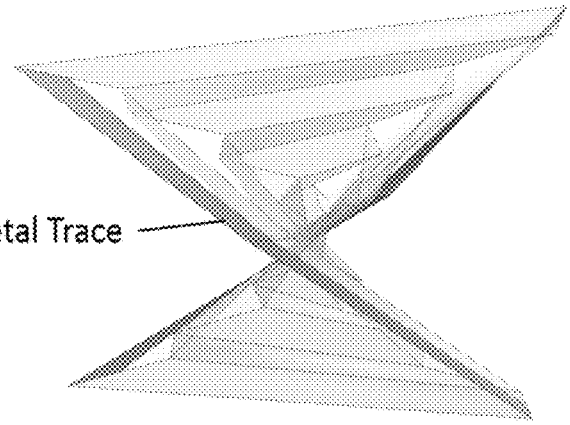
FIG. 13B shows a schematic view of a foldable origami antenna with a metal trace.
Figure 14A:
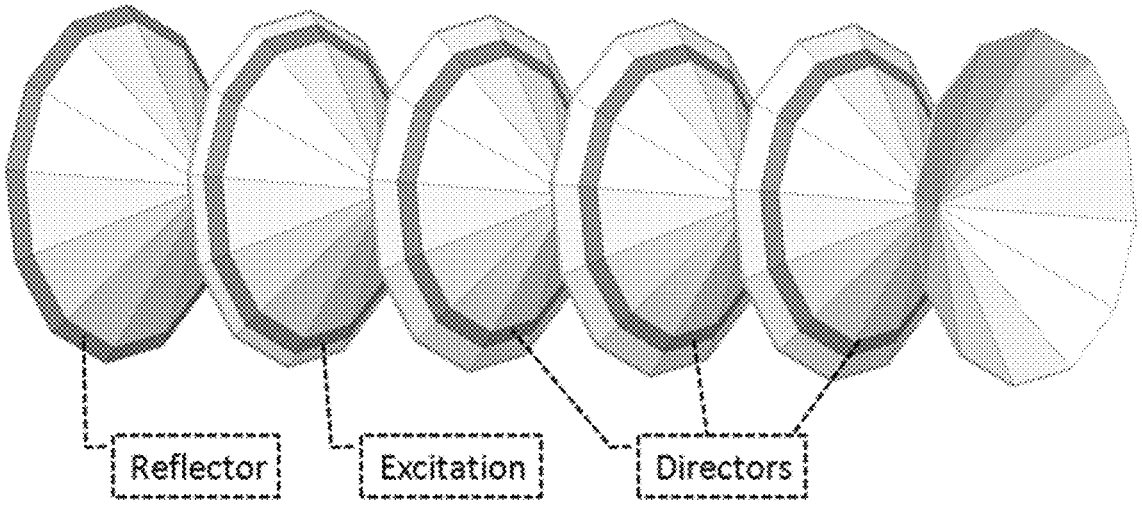
FIG. 14A shows a schematic view of an origami antenna with multiple substrates, including a reflector, an excitation substrate, and directors.
Figure 14B:
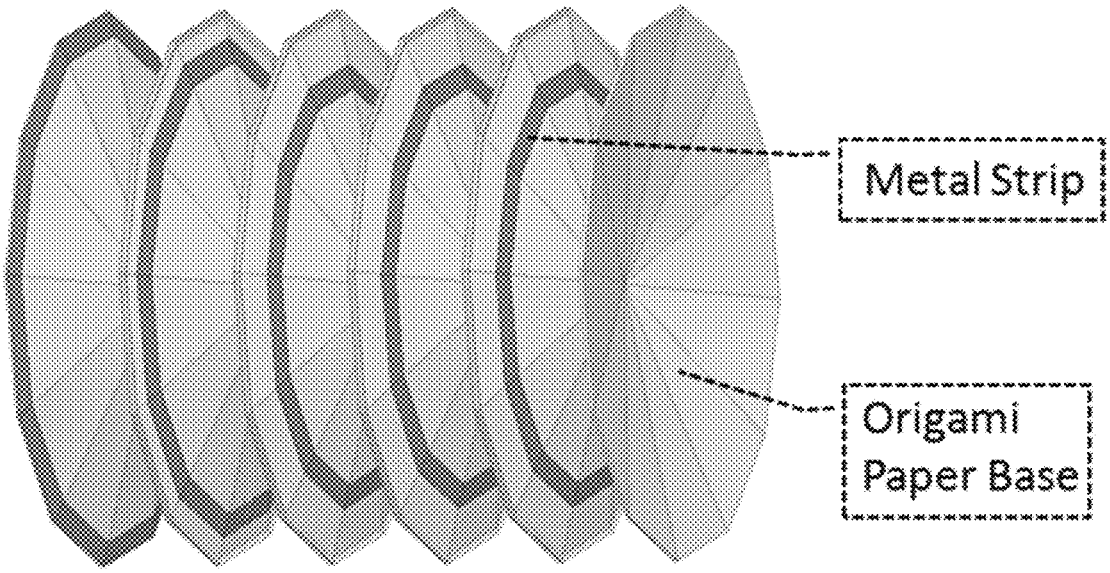
FIG. 14B shows a schematic view of an origami antenna with multiple substrates, emphasizing the metal strip and the paper base(s).
Figure 15A:
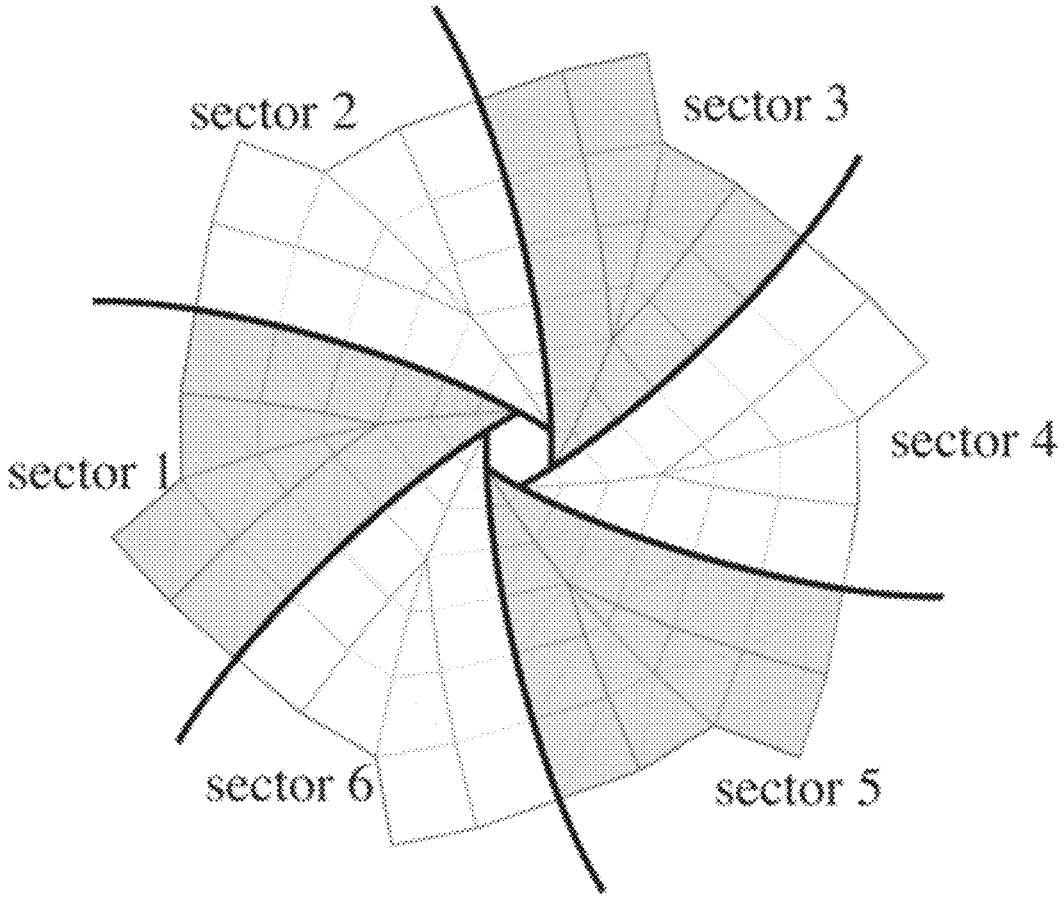
FIG. 15A shows a schematic view of a flat origami flasher pattern.
Figure 15B:
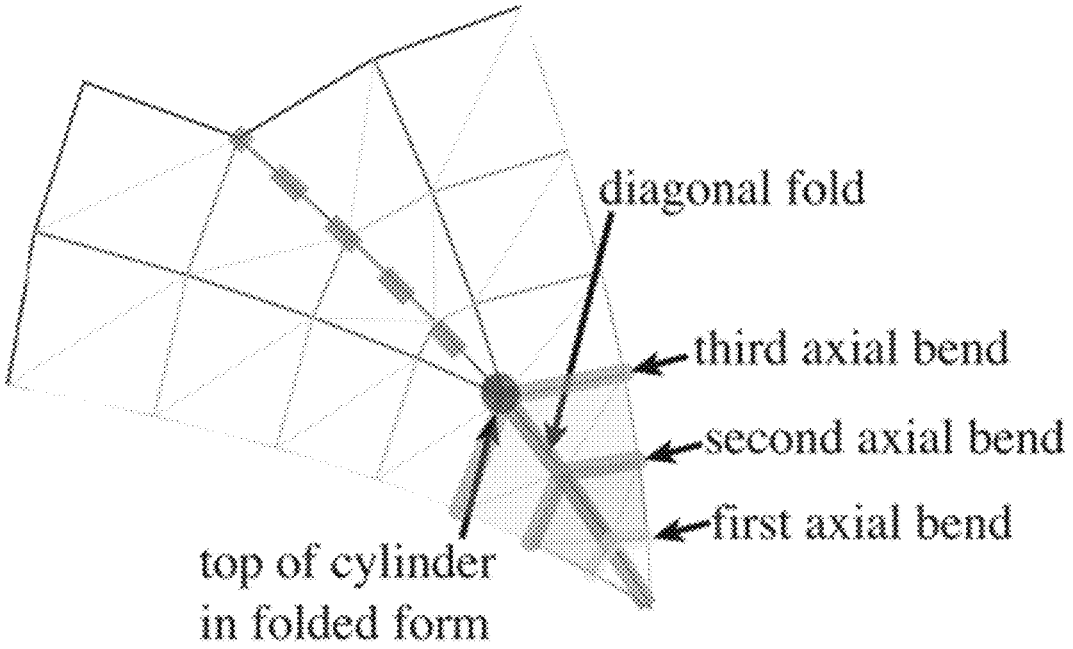
FIG. 15B shows a schematic view of a sector of the flat origami flasher pattern of FIG. 15A.
Figure 15C:
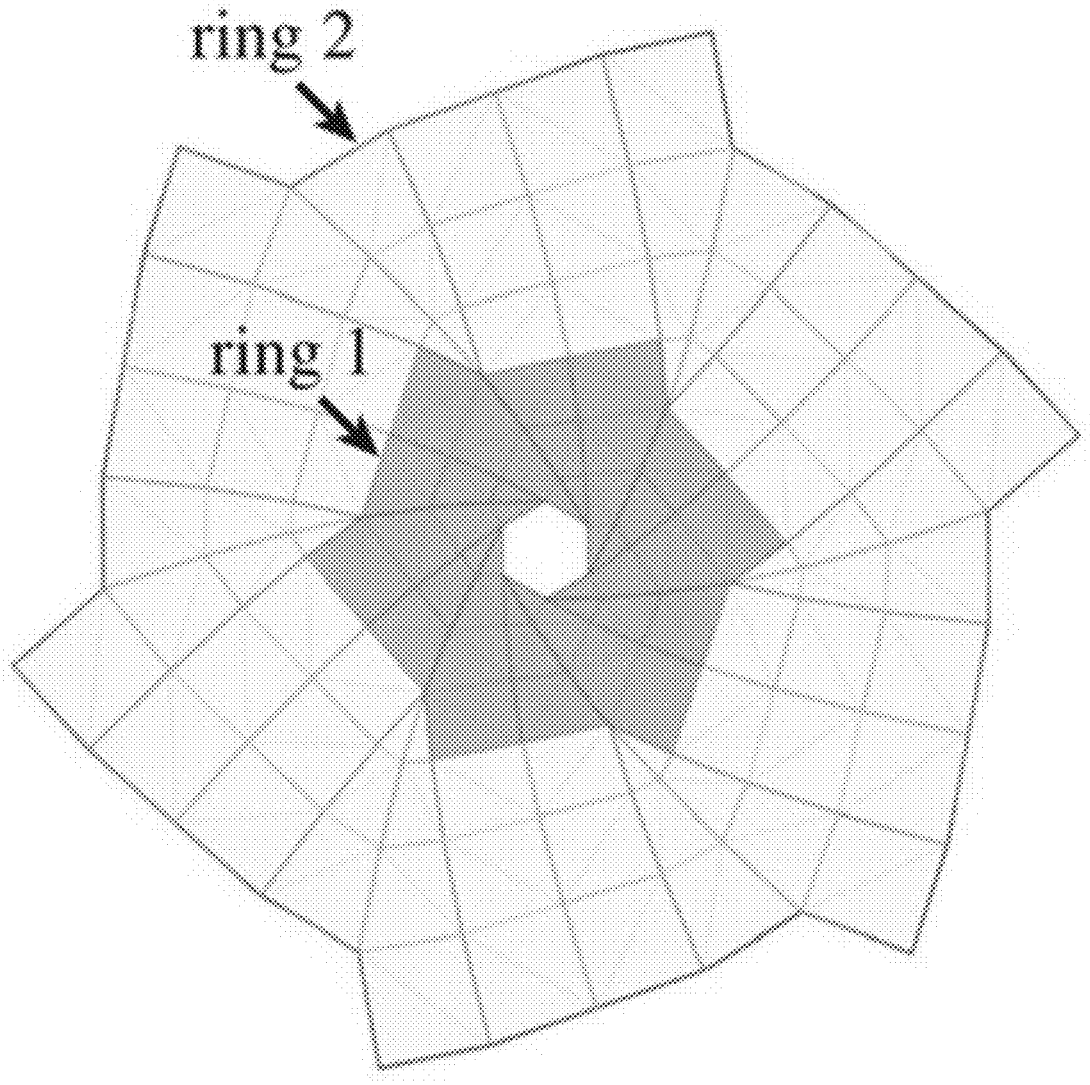
FIG. 15C shows another schematic view of the flat origami flasher pattern of FIG. 15A.
Figure 16:
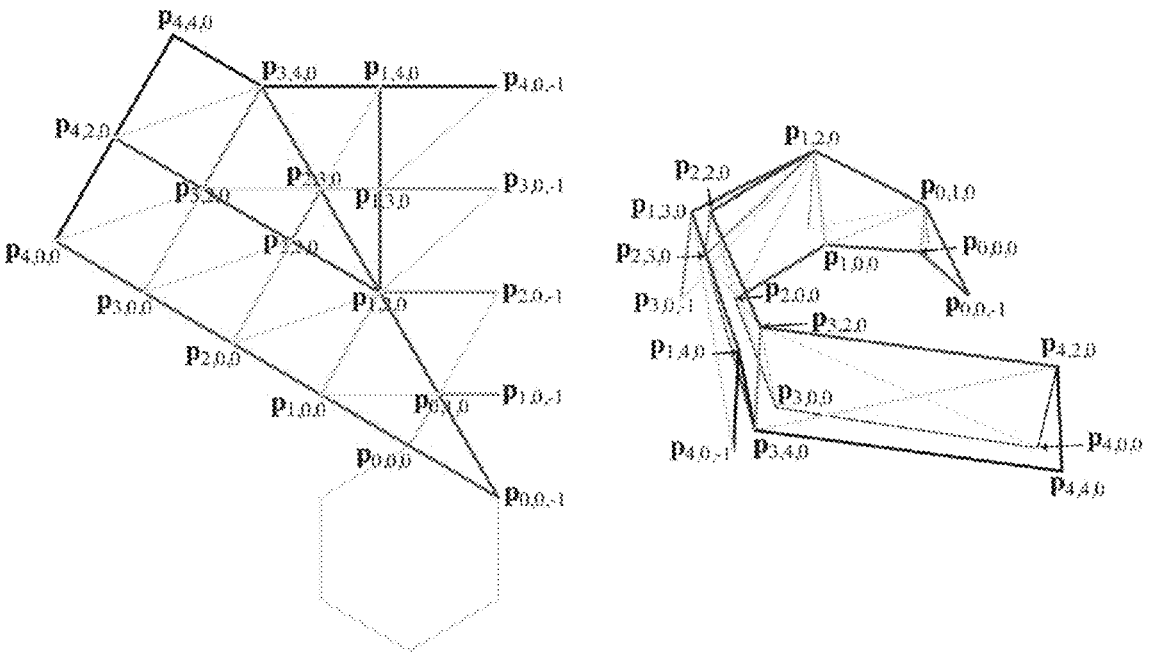
FIG. 16 shows a schematic view of a coordinate system of a sector of the flat origami flasher pattern of FIG. 15A at an unfolded state (left) and a fully folded state (right).
Figure 17:
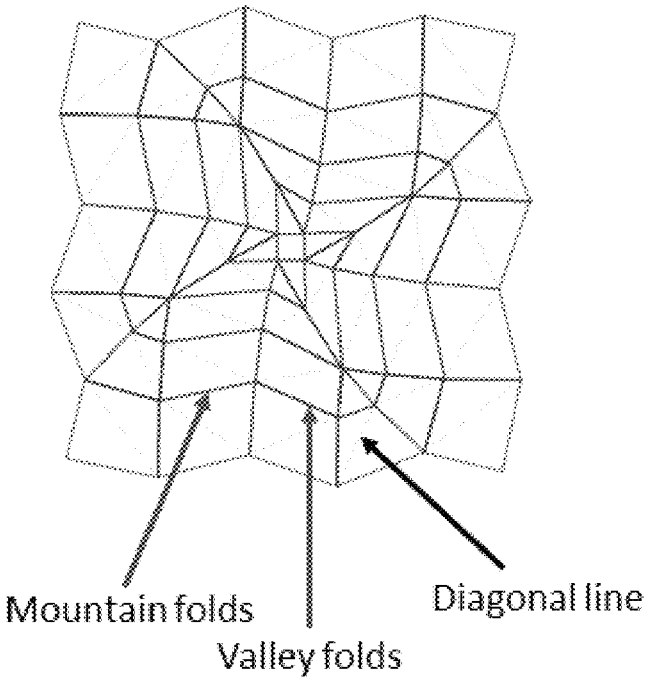
FIG. 17 shows a schematic view of a flat origami flasher pattern with mountain folds, valley folds, and diagonal lines indicated. The darkest (blue) lines are for valley folds; the next-darkest (red) lines are for mountain folds; and the lightest (gray) lines are for diagonal lines.
Figure 18A:
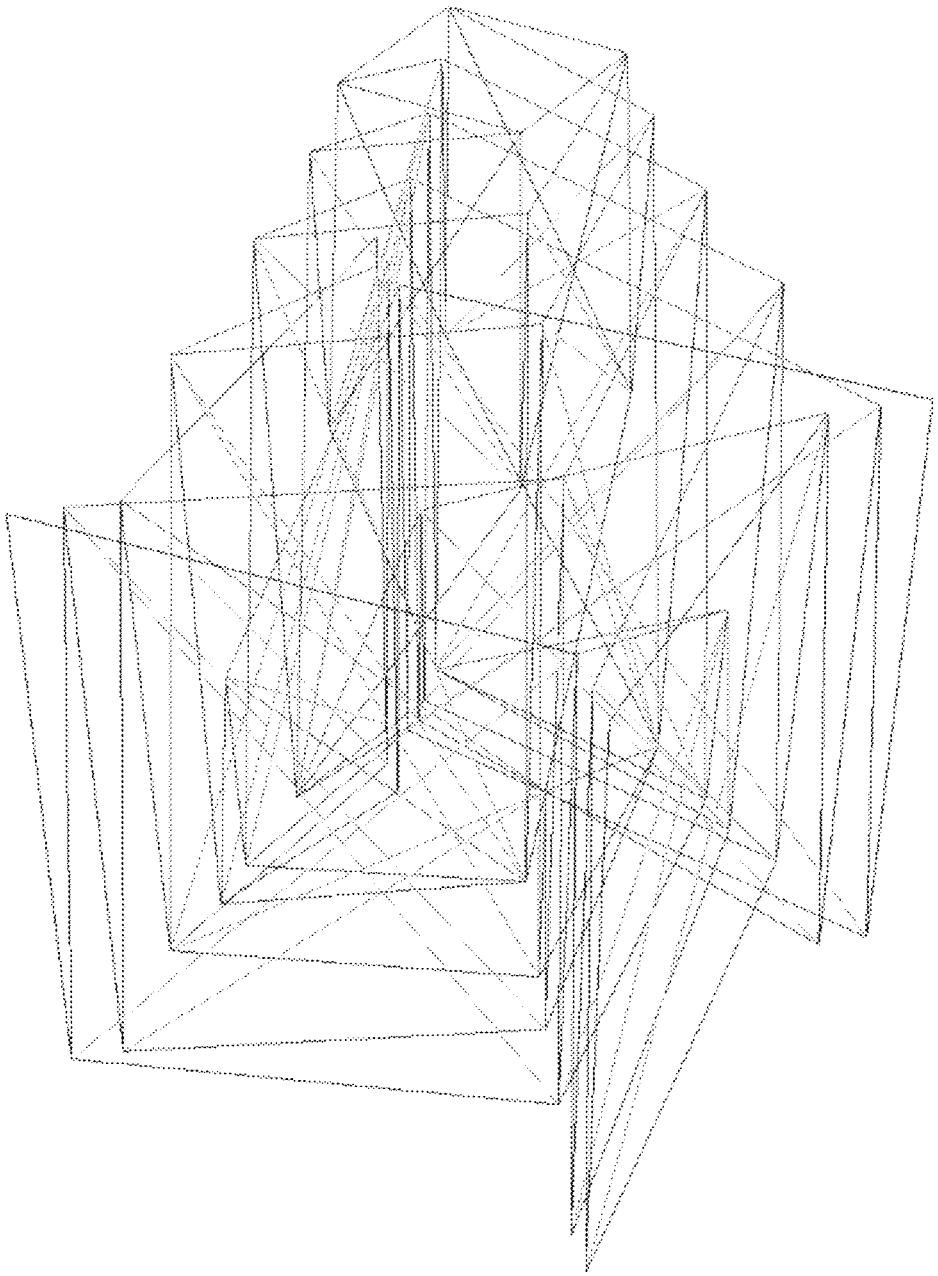
FIG. 18A shows a schematic view of an origami flasher pattern.
Figure 18B:
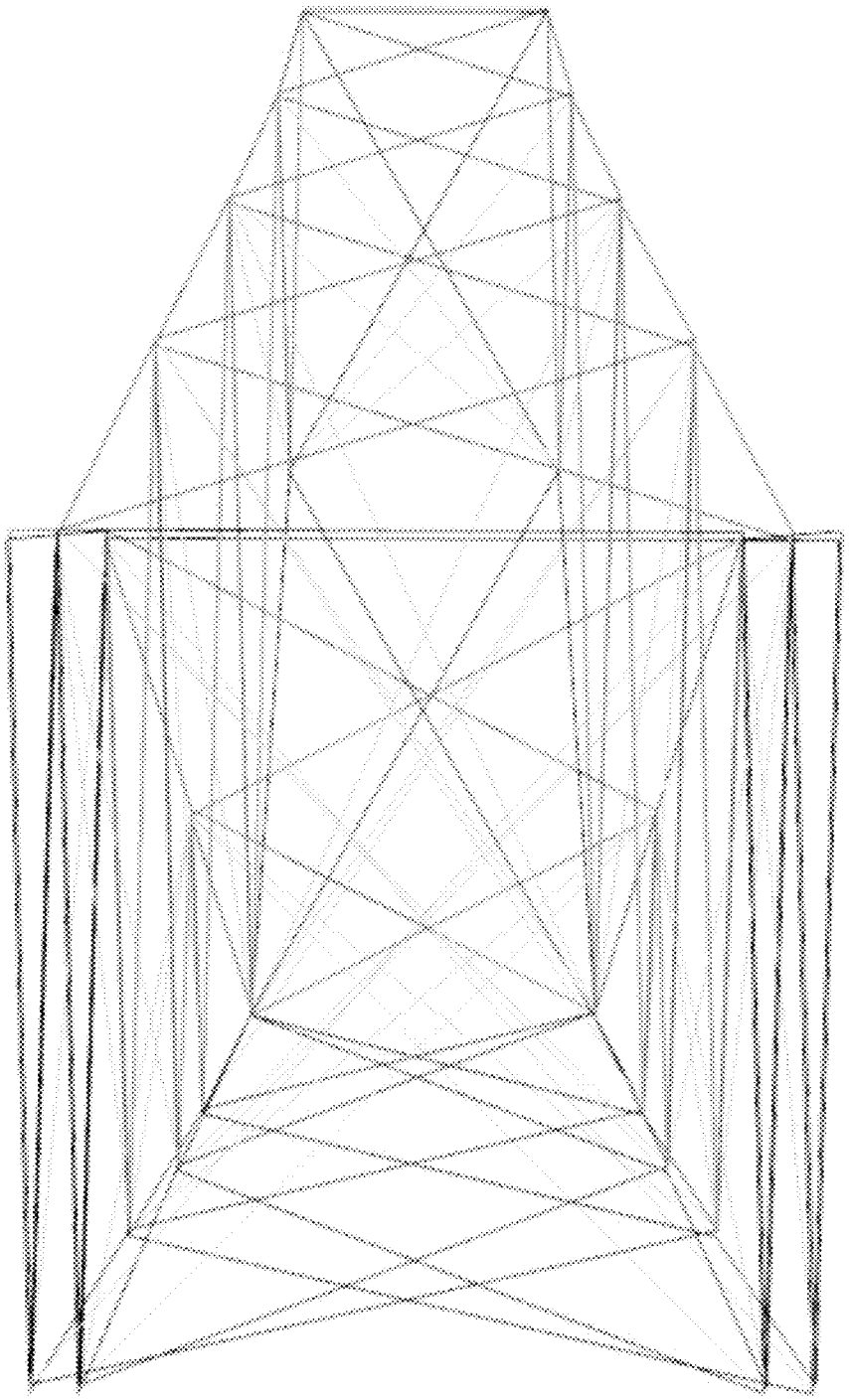
FIG. 18B shows a schematic view of an origami flasher pattern.
Figure 19A:
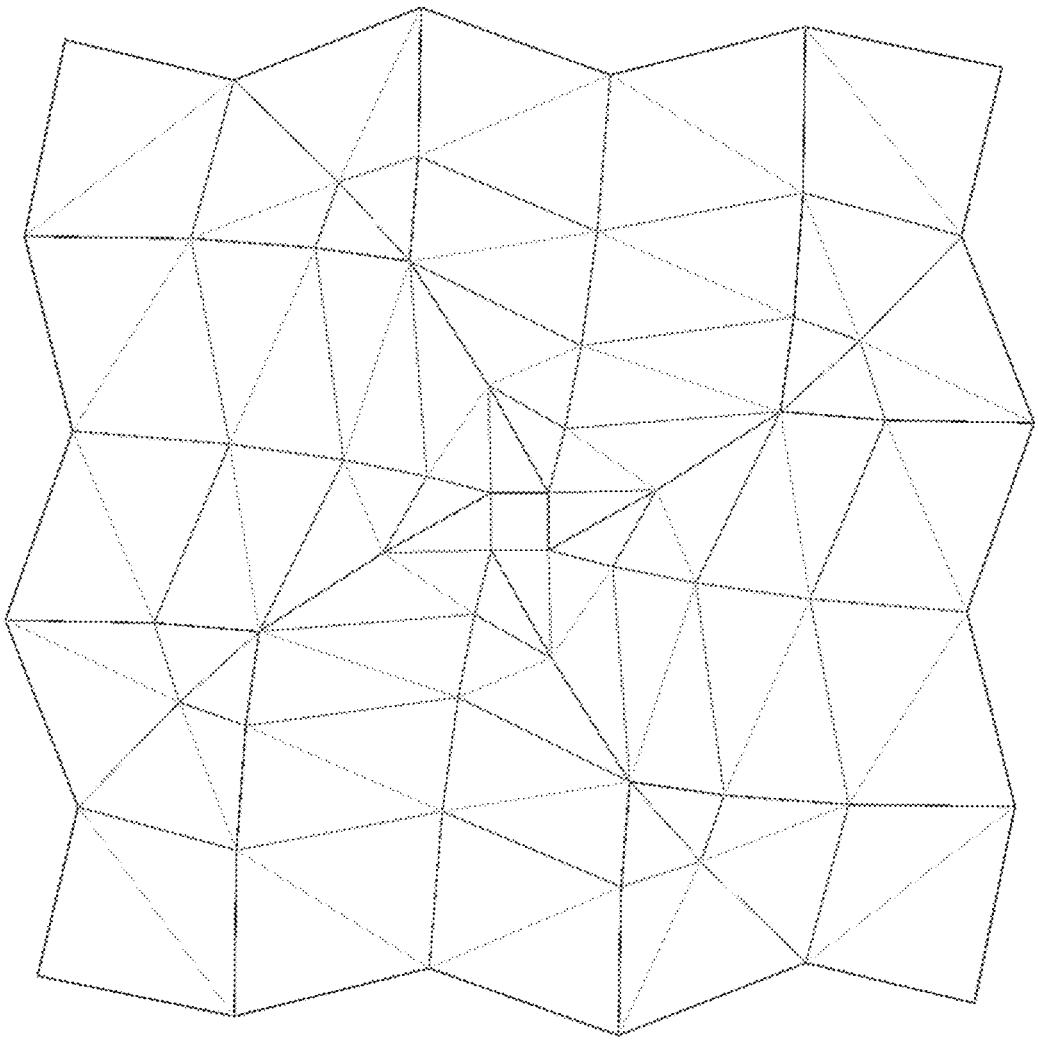
FIG. 19A shows a schematic view of a flat origami flasher pattern with parameters of m=4, r=2, h=2, dr=0.15, and dz=0.7. The darkest (blue) lines are for valley folds; the next-darkest (red) lines are for mountain folds; and the lightest (gray) lines are for diagonal lines.
Figure 19B:
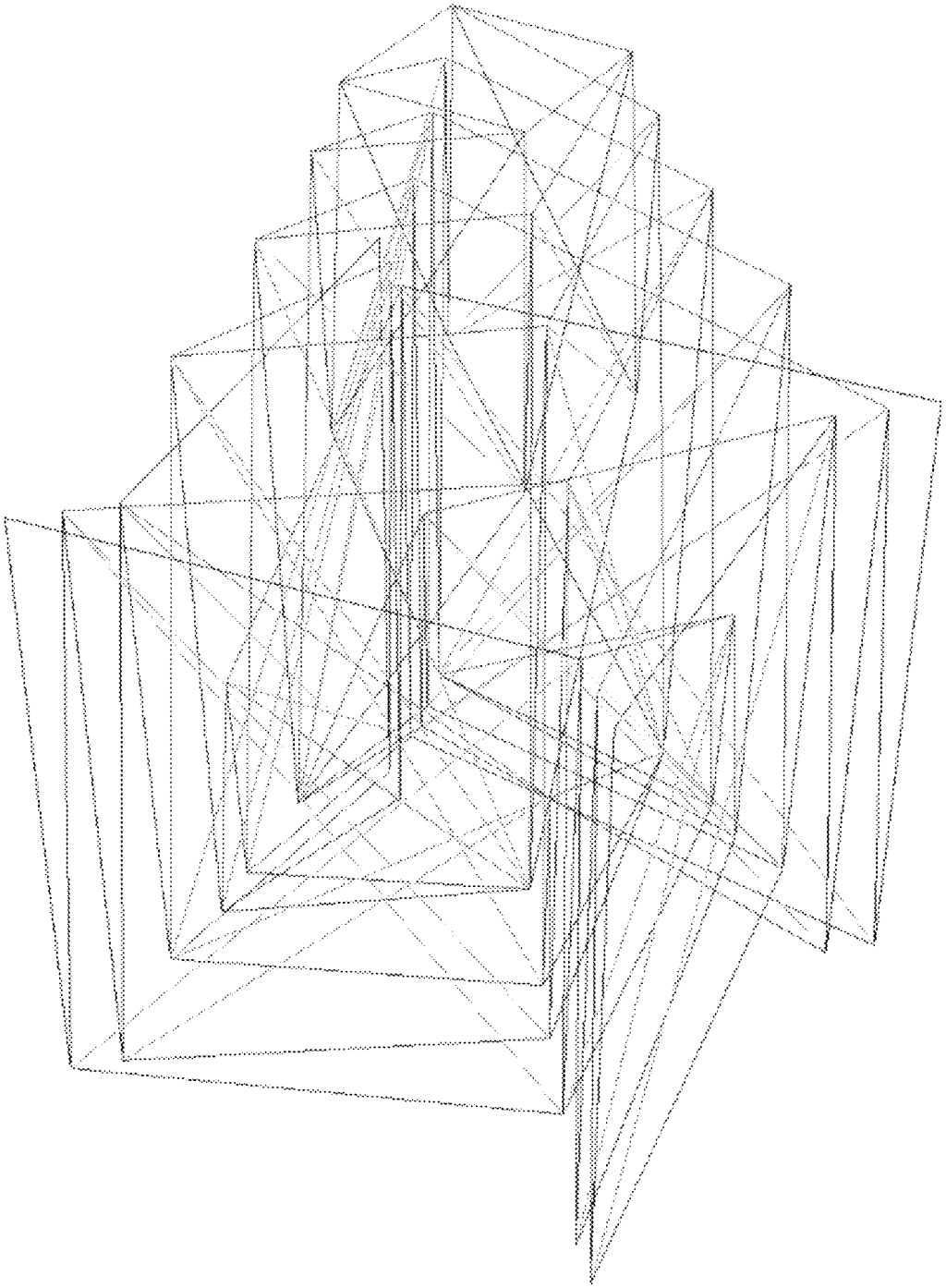
FIG. 19B shows a schematic view of the origami flasher pattern of FIG. 19A, in a folded state.
Figure 19C:
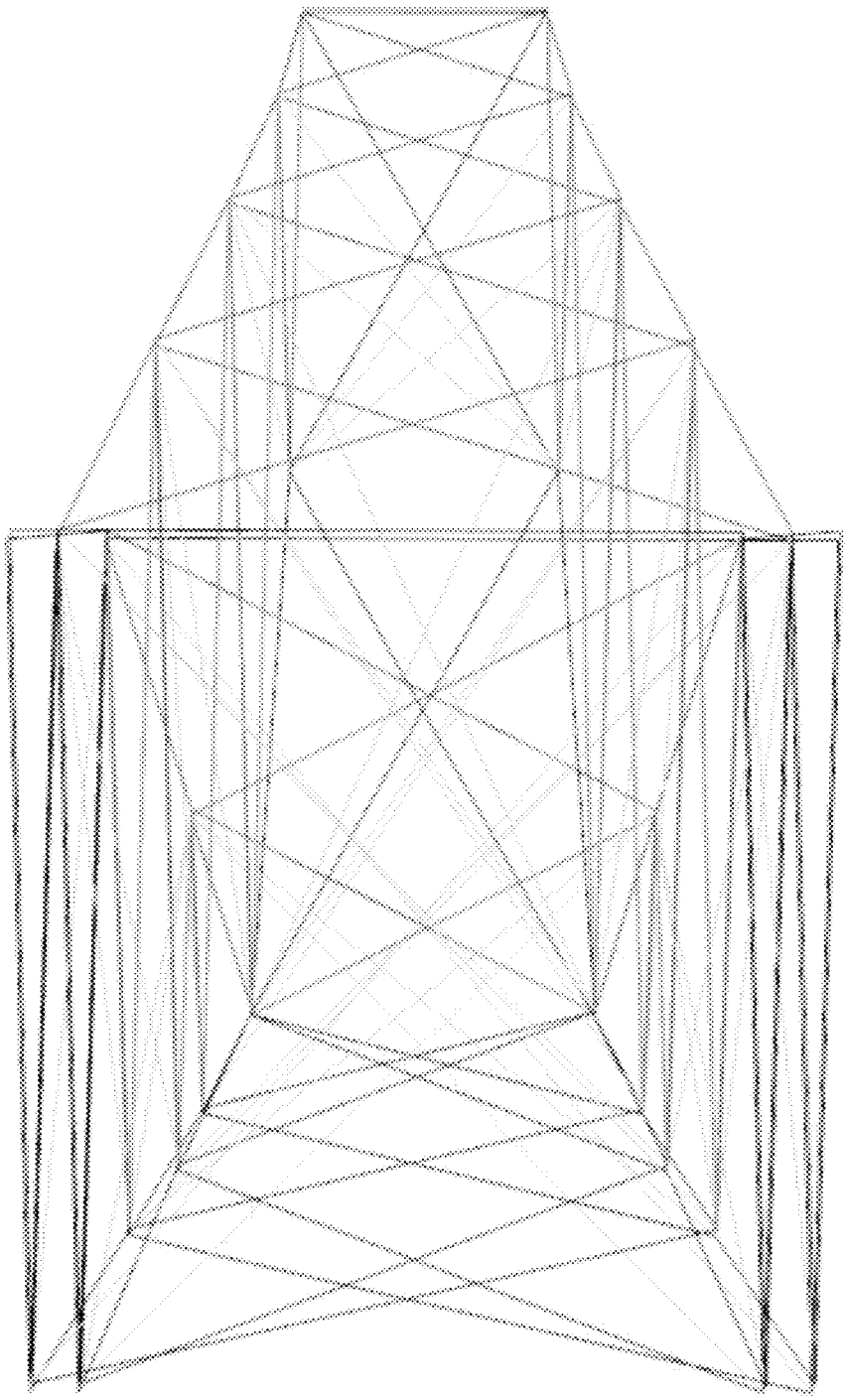
FIG. 19C shows a schematic view of the origami flasher pattern of FIG. 19A, in a folded state, viewed from the side.
Figure 19D:
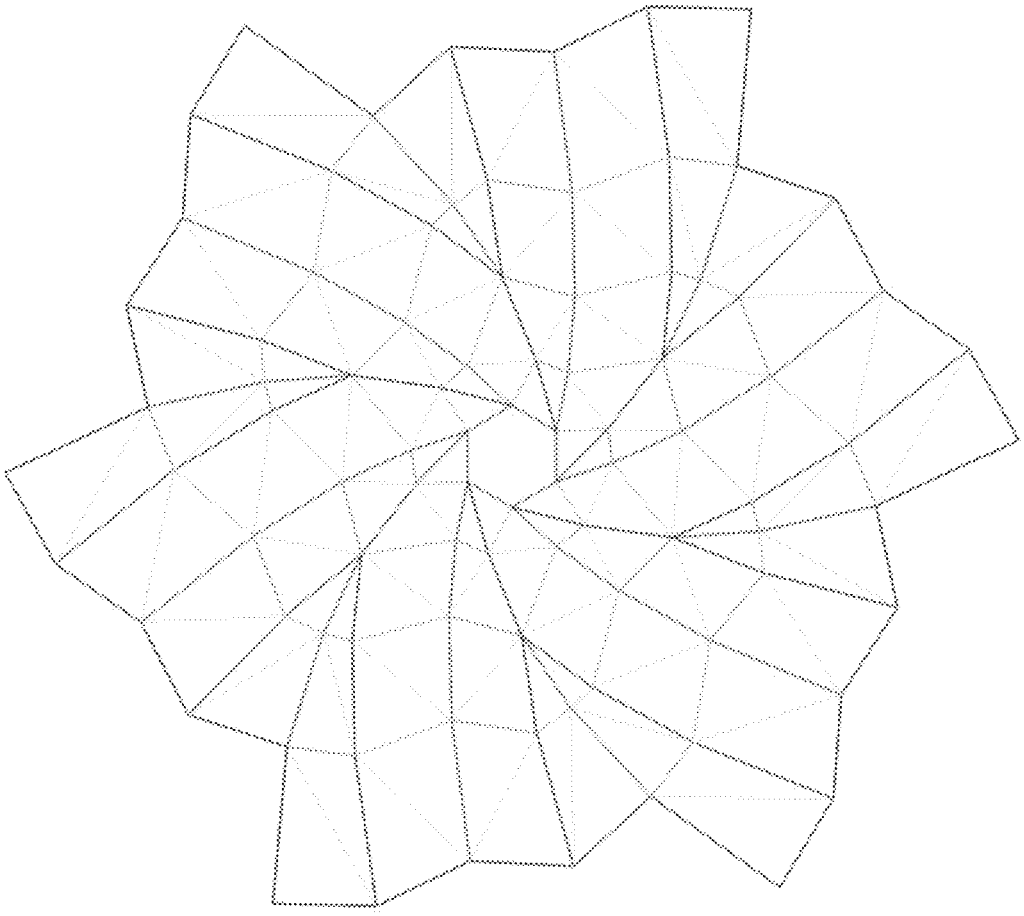
FIG. 19D shows a schematic view of a flat origami flasher pattern with parameters of m=6, r=2, h=2, dr=0.2, and dz=0.75. The darkest (blue) lines are for valley folds; the next-darkest (red) lines are for mountain folds; and the lightest (gray) lines are for diagonal lines.
Figure 19E:
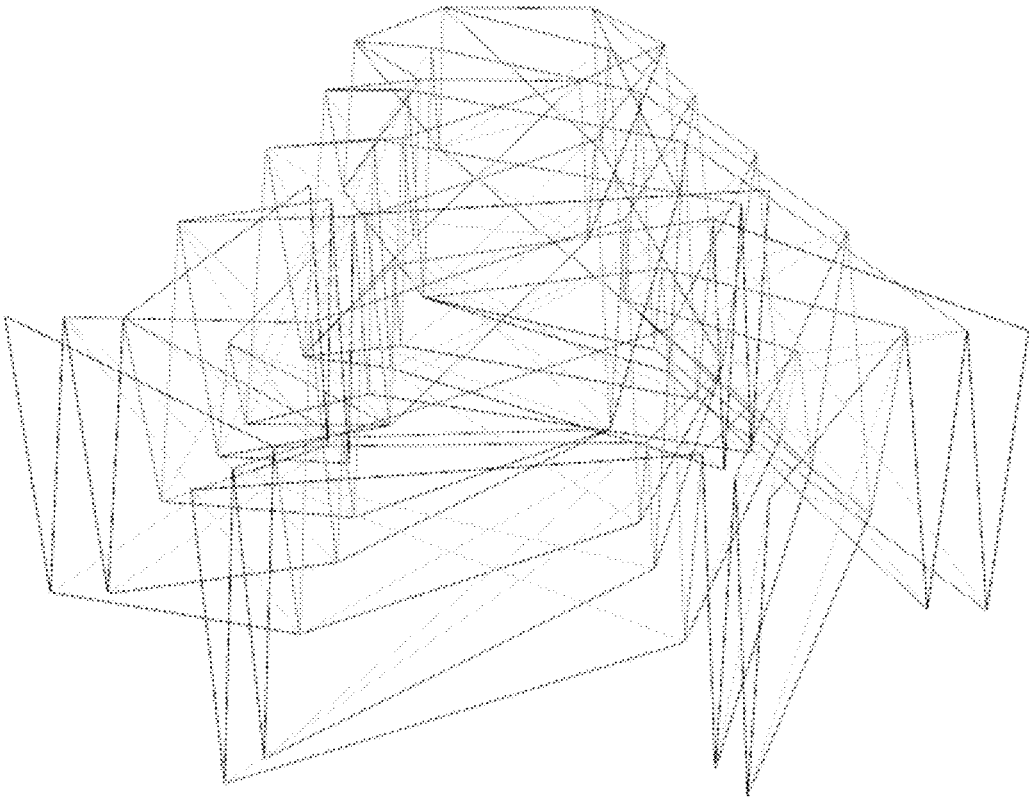
FIG. 19E shows a schematic view of the origami flasher pattern of FIG. 19D, in a folded state.
Figure 19F:
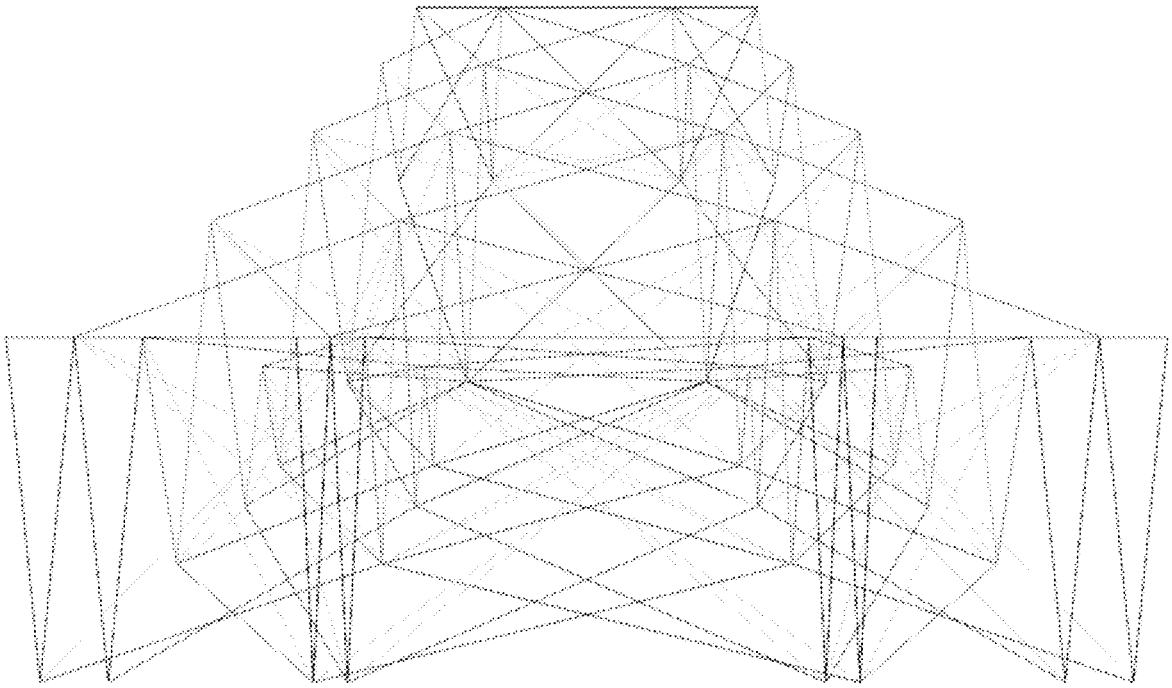
FIG. 19F shows a schematic view of the origami flasher pattern of FIG. 19D, in a folded state, viewed from the side.

FIG. 12A shows the elevation pattern for the right-handed and left-handed circularly polarized components of the electric field for the segmented CSA, with φ=0° and a frequency of 2.5 GHz; FIG. 12B shows the elevation pattern for the right-handed and left-handed circularly polarized components of the electric field for the segmented CSA, with φ=90° and a frequency of 2.5 GHz; FIG. 12C shows the elevation pattern for the right-handed and left-handed circularly polarized components of the electric field for the segmented CSA, with φ=0° and a frequency of 3.5 GHz; and FIG. 12D shows the elevation pattern for the right-handed and left-handed circularly polarized components of the electric field for the segmented CSA, with φ=90° and a frequency of 3.5 GHz. Referring to FIGS. 12A-12D, the segmented CSA was right-handed circularly polarized as expected and the radiation pattern was directional towards the zenith. It should be pointed out that the two frequencies in FIGS. 10 and 12 were selected randomly from the operating frequency band. Antennas of embodiments of the subject invention exhibit consistent directional patterns in the operating frequency band. The E-plane beamwidth varied from 142° to 174° in the operating frequency band, and the beamwidth got wider in the higher frequency range.

FIGS. 8-10 show that the segmented CSA has broadband performance. The bandwidth can be calculated as $f_{max}/f_{min}$, which is approximately 1.76. The measured bandwidth is smaller than the theoretical BW value previously derived from Equation 9. That is because the BW in Equation 9 is derived based on the traditional CSA model, and the operating bandwidth of the segmented CSA is always narrower than the traditional CSA. If the number of sides (m) of the central hub of the segmented CSA model is increased, the antenna input impedance and BW will be closer compared to the traditional CSA.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. A device, comprising:

a rigid substrate configured to be folded;

a framework to which the substrate is attached;

an actuator to which the substrate is attached; and an antenna element disposed on the rigid substrate, the rigid substrate being configured to be folded by having hinges for folding into a predetermined configuration, such that the device has an unfolded state and a fully folded state, the actuator being configured to fold the substrate back and forth between the unfolded state and the fully folded state, and the framework surrounding an outer perimeter of the substrate in both the unfolded state and the fully folded state, the rigid substrate having a thickness of at least 6.5 mm, and the rigid substrate comprising glass epoxy laminate.

2. The device according to claim 1, the rigid substrate comprising a central hub, and the antenna element comprising a metal layer disposed symmetrically about the central hub.

3. The device according to claim 1, the device being configured to operate as a linearly polarized dipole antenna in the unfolded state and a circularly polarized broadband antenna in the fully folded state.

4. The device according to claim 1, the antenna element being a segmented conical spiral antenna in the fully folded state of the device.

5. The device according to claim 1, the rigid substrate being an origami flasher pattern.

6. The device according to claim 1, the antenna element having an operating bandwidth of at least 1.76 GHz in the fully folded state of the device.

7. The device according to claim 1, further comprising a balun disposed on the rigid substrate and electrically connected to the antenna element, the device being configured such that the balun is totally inside the device in the fully folded state.

8. A method of fabricating a foldable antenna device, array device, or frequency selective surface device, the method comprising:

providing a rigid substrate configured to be folded;

providing hinges between sections of the rigid such that the rigid substrate is configured to be folded into a predetermined configuration, such that the device has an unfolded state and a fully folded state;

forming an antenna element on the rigid substrate; and attaching the rigid substrate to a framework and an actuator, the actuator being configured to fold the substrate back and forth between the unfolded state and the fully folded state, and the framework surrounding an outer perimeter of the substrate in both the unfolded state and the fully folded state, the rigid substrate having a thickness of at least 6.5 mm, and the rigid substrate comprising glass epoxy laminate.

9. The method according to claim 8, the rigid substrate comprising a central hub, and the antenna element comprising a metal layer disposed symmetrically about the central hub.

10. The method according to claim 8, the device being configured to operate as a linearly polarized dipole antenna in the unfolded state and a circularly polarized broadband antenna in the fully folded state.

11. The method according to claim 8, the antenna element being a segmented conical spiral antenna in the fully folded state of the device.

12. The method according to claim 8, the rigid substrate being an origami flasher pattern.

13. The method according to claim 8, the antenna element having an operating bandwidth of at least 1.76 GHz in the fully folded state of the device.

14. The method according to claim 8, further comprising:

disposing a balun on the rigid substrate; and electrically connecting the balun and the antenna element, the balun being disposed on the rigid substrate such that the balun is totally inside the device in the fully folded state.

15. A foldable antenna device, comprising:

a rigid substrate configured to be folded;

a framework to which the substrate is attached;

an actuator to which the substrate is attached;

an antenna element disposed on the rigid substrate; and a balun disposed on the rigid substrate and electrically connected to the antenna element, the rigid substrate being configured to be folded by having hinges for folding into a predetermined configuration, such that the foldable antenna device has an unfolded state and a fully folded state, the actuator being configured to fold the substrate back and forth between the unfolded state and the fully folded state, and the framework surrounding an outer perimeter of the substrate in both the unfolded state and the fully folded state, the rigid substrate comprising a central hub, the antenna element comprising a metal layer disposed symmetrically about the central hub, the foldable antenna device being configured to operate as a linearly polarized dipole antenna in the unfolded state and a circularly polarized broadband antenna in the fully folded state, the foldable antenna being a segmented conical spiral antenna in the fully folded state, the rigid substrate being an origami flasher pattern, the rigid substrate having a thickness of at least 6.5 mm, the foldable antenna device having an operating bandwidth in the fully folded state of at least 1.76 GHz, the foldable antenna device being configured such that the balun is totally inside the foldable antenna device in the fully folded state, and the rigid substrate comprising glass epoxy laminate.

* * * * *